US005779872A

United States Patent [19]

Kito et al.

[11] Patent Number: 5,779,872

[45] Date of Patent: Jul. 14, 1998

[54] COMPOSITE MATERIAL HAVING ANTI-WEAR PROPERTY AND PROCESS FOR PRODUCING THE SAME

[75] Inventors: Satoru Kito, Aichi-ken; Masahito Ito; Fuminori Matuda, both of Toyota; Eiki Takeshima, Ichikawa; Yasuji Tanaka, Ichikawa; Takahiro Fujii, Ichikawa; Kenjiro Izutani, Ichikawa, all of Japan

[73] Assignees: Toyota Jidosha Kabushiki Kaisha; Nisshin Steel Co., Ltd., both of Japan

[21] Appl. No.: 745,207

[22] Filed: Nov. 8, 1996

Related U.S. Application Data

[60] Division of Ser. No. 258,635, Jun. 10, 1994, Pat. No. 5,641,454, which is a continuation-in-part of Ser. No. 31,093, Mar. 11, 1993, abandoned.

[30] Foreign Application Priority Data

| | | | |
|---|---|---|---|
| Mar. 13, 1992 | [JP] | Japan | 4-55366 |
| Aug. 24, 1992 | [JP] | Japan | 4-246053 |
| Aug. 24, 1992 | [JP] | Japan | 4-246054 |
| Sep. 3, 1992 | [JP] | Japan | 4-235729 |
| Oct. 29, 1993 | [JP] | Japan | 5-272423 |
| Oct. 29, 1993 | [JP] | Japan | 5-272429 |
| Nov. 12, 1993 | [JP] | Japan | 5-283647 |

[51] Int. Cl.[6] ..... C02F 1/46

[52] U.S. Cl. ..... 205/149; 205/191; 205/194

[58] Field of Search ..... 205/149, 191, 205/194

[56] References Cited

U.S. PATENT DOCUMENTS

| | | |
|---|---|---|
| 3,377,143 | 4/1968 | Alexander . |
| 3,566,512 | 3/1971 | Lane . |
| 3,622,283 | 11/1971 | Sara . |
| 4,224,060 | 9/1980 | De Souza et al. . |
| 4,415,529 | 11/1983 | Masumoto et al. . |
| 4,962,003 | 10/1990 | Lyhmm et al. . |
| 5,039,576 | 8/1991 | Wilson . |
| 5,066,544 | 11/1991 | Betrabet et al. . |

FOREIGN PATENT DOCUMENTS

| | | |
|---|---|---|
| 2-25533 | 1/1990 | Japan . |
| 2-142698 | 5/1990 | Japan . |

OTHER PUBLICATIONS

Goetzel, "Treatise On Powder Metallurgy", 1949, pp. 112–117, and 208–211.

Manko, "Solders and Soldering", 1964, pp. 8–25.

Semalloy, "Solder Alloy", 1968, one page.

"Fusible Alloys Containing Tin", Tin Research Institute, TN 193, T7f Cop. 2.

Merriman, "A Dictionary of Metallurgy", 1958, p. 328.

*Primary Examiner*—John Sheehan

*Attorney, Agent, or Firm*—Finnegan, Henderson, Farabow, Garrett & Dunner, L.L.P.

[57] ABSTRACT

Disclosed are a composite material having an anti-wear property and a process for producing the same. The composite material includes a matrix of a low melting point Sn alloy having a melting point of from 80° to 280° C., and metallic dispersing particles dispersed in the matrix in an amount of from 10 to 50% by volume. When the composite material is utilized to make a rough mold for preparing a prototype, it sharply improves the anti-wear property of the rough mold, and it can be re-used for a plurality of times without adversely affecting the sharply improved anti-wear property. The composite material provides the advantageous effect best when the metallic dispersing particles are Fe—C alloy dispersing particles and/or Fe—W—C alloy dispersing particles which were subjected to a surface treatment including an Sn or Ni electroplating followed by a $ZnCl_2 \cdot NH_4Cl$ flux depositing.

8 Claims, 8 Drawing Sheets

WEAR AMOUNT VARIATION OF TEST SPECIMENS 1

COMPOSITE MATERIAL HAVING ANTI-WEAR PROPERTY AND PROCESS FOR PRODUCING THE SAME

CROSS REFERENCE TO RELATED APPLICATIONS

This is a division of application Ser. No. 08/258,635, filed Jun. 10, 1994 now U.S. Pat. No. 5,641,454 which is a continuation-in-part of application Ser. No. 08/031,093, filed Mar. 11, 1993, abandoned.

BACKGROUND OF THE INVENTION

1. Field of the Invention

The present invention relates to a composite material having an anti-wear property.

2. Description of the Related Art

There has been a low melting point alloy which exhibits a good flowing ability and a superb molding ability when heated and mettled. The low melting point alloy is used in order to produce a rough mold or preparing a prototype by casting, for instance, it is used to produce a rough pressing die, a rough injection molding mold or the like by casting.

As the low melting point alloy, there is a binary eutectic alloy including Bi and Sn, e.g., a low melting point Bi-Sn eutectic alloy (hereinafter referred to as "Conventional Example Alloy No. 1"). Further, there is another low melting point alloy (hereinafter referred to as "Conventional Example Alloy No. 2") which is set forth in Japanese Unexamined Patent Publication (KOKAI) No. 2-25,533. Conventional Example Alloy No. 2 is made by adding Sb to the Conventional Example Alloy No.1, and it is precipitated as solid solution. These two low melting point alloys, Conventional Example Alloy No. 1 and Conventional Example Alloy No. 2, have a melting point of about 139° C. and about 200° C., respectively, and they are based on the binary eutectic alloy.

Three pressing dies were prepared by casting by using Conventional Example Alloy No. 1, Conventional Example Alloy No. 2 and a commercially available alloy including Zn as the principal component (hereinafter referred to as Conventional Example Alloy No. 3) is order to evaluate the advantages and disadvantages of the 3 alloys. Conventional Example alloy No. 3 is made by MITSUI KINZOKU KOGYO CO., LTD. and sold under a trade name of "ZAS, " and it has a melting point of 380° C. aproximately. The evaluation was conducted as follows: The 3 conventional alloys were made into test pieces in a rectangular parallelepiped having a size of 15 mm×15 mm×120 mm, and the test pieces were assembled in a pressing die as illustrated in FIG. 6. Then, a plurality of galvanized steel sheets having a thickness of 1.6 mm were pressed with the 3 pressing dies, and cross sectional worn areas of the test pieces illustrated in FIG. 7 were measured for wear amounts (in $mm^2$) with respect to the number of pressing shots in order examine the anti-wear property of the 3 conventional alloys. As a result, it was found that Conventional Example Alloy No. 1 and Conventional Example Alloy No. 2 reduce the time required for producing the pressing die (or the test pieces) and are superior in the working ability and the manufacturing cost because they have a melting point far lower than that of Conventional Example No. 3. However, it was found that they are far inferior in the anti-wear property. For instance, as illustrated in FIG. 1, the anti-wear property of the test pieces made from Conventional Example Alloy Nos. 1 and 2 (designated with "a1" and "a2" curves, respectively, in the drawing) were remarkably inferior to that of the test pieces made from Conventional Example Alloy No. 3 (designated with "a3" curve in the drawing).

SUMMARY OF THE INVENTION it is a primary object of the present invention to provide a composite material, which not only enables to reduce the time required for producing a rough mold, such as a pressing rough die, a rough injection molding mold or the like, for preparing a prototype by casting, but also exhibits excellent properties in the working ability, the manufacturing cost, the anti-wear property and the like. Further, it is a secondary object of the present invention to provide a process for producing the composite material. Furthermore, it is a tertiary object of the present invention to provide metallic dispersing particles which can be favorably added to and mixed with the low melting point Sn alloy being superior in reducing the time for producing the rough mold and the manufacturing cost, and metallic dispersing particles which enable to improve the anti-wear property of the low melting point Sn alloy. Moreover, it is a quaternary object of the present invention to provide a process for producing the metallic dispersing particles.

A composite material having an anti-wear property according to the present invention comprises:

a matrix of a low melting point Sn alloy having a melting point of from 80° to 280° C.; and metallic dispersing particles dispersed in the matrix in an amount of from 10 to 50% by volume.

The low melting point Sn alloy constituting the matrix can be any Sn alloy which has a melting point of from 80° to 280° C., or from 135° to 230° C. preferably. For example, when using the present composite material for making the rough molds, it is preferred to adjust the melting point of the low melting point Sn alloy at 230° C. or less, since models for casting the rough molds do not usually have heat resistance in the temperature range over 230° C. Further, the low melting point Sn alloy can be Bi—Sn, Sn—Pb, Sn—Zn, Sn—Cu alloys, or the Bi—Sn alloys with Sb added. As far as the Sn alloy has a melting point of from 80° to 280° C., the weight ratio between the metallic components can be set variously in the Sn alloy depending on the purposes of the actual applications. These alloys can be used in the present composite material because they have a low melting point and exhibit a good flowing ability.

In particular, in the case that the low melting point Sn alloy is a Bi—Sn alloy free from the other metallic components, it is preferable to set the weight ratio of Bi:Sn at the eutectic point, i.e., 58:42, in the Bi—Sn alloy, because the low melting point Bi—Sn eutectic alloy has the lowest melting point and the matrix of the low melting point Bi—Sn eutectic alloy comes to melt with the least thermal energy. However, when a low melting point Sn—Zn eutectic alloy containing Sn in an amount of 92% by weight and Zn in an amount of 8% by weight, i.e., a low melting point Sn—8 Zn eutectic alloy, or a low melting point Sn—Cu eutectic alloy containing Sn in an amount of 99.25% by weight and Cu in an amount of 0.75% by weight, i.e., a low melting point Sn—0.75 Cu eutectic alloy, is used in the present composite material, the cost can be reduced to 1/10 of the present composite material in which the low melting point Bi—Sn eutectic alloy is used.

Naturally, other than the above-mentioned low melting point eutectic alloys in which the weight ratio between the 2 metallic components forming the alloys are set at the eutectic points, the low melting point Sn alloy can be Bi—Sn, Sn—Pb, Sn—Zn and Sn—Cu alloys in which the weight ratios between the 2 metallic components forming the alloys are set around the eutectic points.

The metallic dispersing particles are dispersed in the matrix of the low melting point Sn alloy, thereby reinforcing and strengthening the matrix.

The present inventors carried out research and development in order to find the metallic dispersing particles which are appropriate for the present composite material. As a result, they discovered the following requirements for the metallic dispersing particles: (a) The metallic dispersing particles need to be added to and mixed with the heated and melted low melting point Sn alloy with ease; (b) The metallic dispersing particles need to be dispersed substantially uniformly in the low melting point Sn alloy when they are added thereto and mixed therewith; (c) Even after a plurality of heating and cooling operations are carried out for melting and solidifying the present composite material, the metallic dispersing particles should not be diffused in the low melting point Sn alloy so as to form solid solution, and they need to maintain the substantially uniformly distributed state; and (d) The metallic dispersing particles need to be sufficiently harder than the low melting point Sn alloy.

The present inventors discovered that the metallic dispersing particles satisfying the above-described requirements are Fe alloy dispersing particles. Here, the Fe alloy dispersing particles mean particles containing Fe only and Fe alloy dispersing particles containing Fe and other metallic or non-metallic components. For instance, the metallic dispersing particles can be Fe—C alloy dispersing particles consisting essentially of C in an amount of 2.0% by weight or less and the balance of Fe and inevitable impurities (hereinafter simply referred to as Fe—C alloy dispersing particles), Fe—W—C alloy dispersing particles consisting essentially of C in an amount of 2.0% by weight or less, W in an amount of from 20 to 30% by weight and the balance of Fe and inevitable impurities (hereinafter simply referred to as Fe—W—C alloy dispersing particles), or the like.

The metallic dispersing particles can be used in a variety of shapes in the present composite material. For example, the metallic dispersing particles can be smooth in the surface, they can be irregular in the surface. Further, the metallic dispersing particles can be a complete sphere in the shape, or they can be a substantial sphere in the shape in order to further enhance the flowing ability of the present composite material.

However, the present inventors discovered that it is preferable to use the following as the metallic dispersing particles in the present composite material. For instance, the preferable metallic dispersing particles can include the Fe—C alloy dispersing particles and/or the Fe—W—C alloy dispersing particles having a substantial sphere shape with a particle diameter of from 10 to 1,000 micrometers, a plating layer formed on outer peripheral surface of the Fe—C alloy dispersing particles and/or the Fe—W—C alloy dispersing particles and including either Sn in an amount of from 1 to 15% by weight or Ni in an amount of from 1 to 10% by weight with respect to the Fe—C alloy dispersing particles and/or the Fe—W—C alloy dispersing particles, and a flux including a $ZnCl_2 \cdot NH_4Cl$ flux and deposited on outer peripheral surface of the Fe—C alloy dispersing particles and/or the Fe—W—C alloy dispersing particles with the plating layer formed in a thickness of from 0.18 to 0.78 micrometers.

The construction of the preferable metallic dispersing particles is arranged in accordance with the following 5 requirements for satisfactorily improving the inferior anti-wear property of the low melting point Sn alloy which is superior in reducing the time for producing the rough mold and the manufacturing cost. The 5 requirements will be hereinafter described in detail.

Requirement on Specific Gravity: The metallic dispersing particles are added to and mixed with the low melting point Sn alloy matrix of the present composite material. The matrix has a specific gravity off from 6.8 to 8.7 approximately. For example, the aforementioned low melting point Bi—Sn eutectic alloy has a specific gravity of 8.73. Accordingly, the metallic dispersing particles need to have a specific gravity around 8.73, the specific gravity of the low melting point Bi—Sn eutectic alloy. Namely, in the case that the specific gravity of the metallic dispersing particles is considerably smaller or larger than that of the low melting point Sn alloy constituting the matrix, the metallic dispersing particles float on the molten matrix immediately after they are charged into, mixed, and stirred with the molten low melting point Sn alloy, or they are sedimented at the bottom of the molten matrix. Hence, the addition of the metallic dispersing particles is useless.

The present inventors investigated a large variety of metallic particles in order to find the metallic dispersing particles which satisfy the specific gravity requirement, which are available at a less expensive cost, and which are superior in the anti-wear property. As a result, they found that the Fe—C alloy dispersing particles and the Fe—W—C alloy dispersing particles satisfy the specific gravity requirement because these alloy dispersing particles have a specific gravity of from 7.8 to 8.8. Particularly, the Fe—C alloy dispersing particles have a specific gravity of about 7.9, and C is included therein so as to raise the hardness. Further, the Fe—W—C alloy dispersing particles have a specific gravity of from 8.61 to 9.18. W is included therein so as to adjust the specific gravity, and C is also included therein so as to raise the hardness. Here, W is included in the Fe—W—C alloy dispersing particles, because it has a specific gravity of 19.30 which is larger than 7.86, i.e., the specific gravity of Fe, and because it is a metallic component which does not diffuse in the low melting point Sn alloy so as to form solid solution. Furthermore, the Fe—C alloy dispersing particles and the Fe—W—C alloy dispersing particles disperse in the matrix uniformly, but they do not diffuse in the matrix so as to form solid solution. Accordingly, the Fe—C alloy dispersing particles and the Fe—W—C alloy dispersing particles can be recycled. In addition, the Fe—C alloy dispersing particles and the Fe—W—C alloy dispersing particles can be electroplated so as to improve their wettability, i.e., one of the 5 requirements as set forth below.

Requirement on Solubility: In the case that the metallic dispersing particles are added to and mixed with the low melting point Sn alloy constituting the matrix of the present composite material and they are diffused therein so as to form solid solution, the advantages resulting from the addition of the metallic dispersing particles are lost when re-melting and re-using the already used present composite material by casting. Accordingly, the metallic dispersing particles need to have a low solubility.

The present inventors investigated a large variety of metallic particles in order to find the metallic dispersing particles which satisfy the solubility requirement, which are available at a less expensive cost, and which are superior in the anti-wear property. As a result, they found that the Fe—C alloy dispersing particles and the Fe—W—C alloy dispersing particles also satisfy the solubility requirement from a plurality of experiments.

Requirement on Particle Diameter: When the metallic dispersing particles are added to and mixed with the low melting point Sn alloy matrix of the present composite material, the metallic dispersing particles need to immediately disperse in the matrix uniformly and the molten matrix with the metallic dispersing particles added need to have a good flowing ability. When the particle diameter of the metallic dispersing particles is too large, the metallic dispersing particles are distributed unevenly in the matrix. As a result, the flowing ability of the molten matrix is adversely affected. Thus, no composite material having a satisfactory quality can be obtained. For instance, no favorable casting can be carried out, and there arise rough surfaces on the cast composite material. On the other hand, when the particle diameter of the metallic dispersing particles is too small and the addition amount thereof is increased, the metallic dispersing particles are distributed unevenly in the matrix. As a result, the flowing ability of the molten matrix is adversely affected. Thus, no composite material having a satisfactory quality can be obtained.

The present inventors examined a large variety of the metallic dispersing particles in order to determine the optimum particle diameter from a plurality of experiments. As a result, they found that the Fe—C alloy dispersing particles and the Fe—W—C alloy dispersing particles having a substantial sphere shape satisfactorily give a good flowing ability to the matrix, and that the particle diameter thereof preferably falls in a range of from 10 to 1,000 micrometers. For instance, when the alloy dispersing particles have a particle diameter of more than 1,000 micrometers, the alloy dispersing particles come off the composite material constituting a part of a pressing die which is brought into contact with and worn by a workpiece to be pressed. On the other hand, when the alloy dispersing particles have a particle diameter of less than 10 micrometers, it is hard to produce such alloy dispersing particles and it takes a long time to produce them. Accordingly, it is inevitable that the production cost increases. Thus, the particle diameter of the alloy dispersing particles preferably falls in a range of from 10 to 1,000 micrometers. In particular, when the alloy dispersing particles have a particle diameter of from 200 to 300 micrometers, they hardly come off the present composite material.

Requirement on Wettability: When the metallic dispersing particles are added to and mixed with the low melting point Sn alloy matrix of the present composite material, the metallic dispersing particles need to distribute in the matrix uniformly. Accordingly, the metallic dispersing particles need to exhibit a satisfactory wettability to the matrix.

The present inventors investigated metals exhibiting a satisfactory wettability to the low melting point Sn alloy through a are variety of experiments. As a result, they found that Sn or Ni exhibits a favorable wettability thereto and can be electroplated on the Fe—C alloy dispersing particles and Fe—W—C alloy dispersing particles with ease by the methods set forth in Japanese Unexamined Patent Publication (KOKAI) No. 1-149,902, Japanese Unexamined Patent Publication (KOKAI) No. 1-272,792, Japanese Unexamined Patent Publication (KOKAI) No. 3-2,392 and Japanese Unexamined Patent Publication (KOKAI) No. 3-2,393, and that Sn or Ni is preferably plated as a plating layer on outer peripheral surface of the Fe—C alloy dispersing particles and/or the Fe—W—C alloy dispersing particles in an Sn amount of from 1 to 15% by weight or in an Ni amount of from 1 to 10% by weight with respect to the Fe—C alloy dispersing particles and/or the Fe—W—C alloy dispersing particles. For instance, when the plating layer is formed in an amount of less than the lower limits with respect to the alloy dispersing particles, the plating layer cannot be provided with the satisfactory wettability to the low melting point Sn alloy constituting the matrix. On the other hand, when the plating layer is formed in an amount of more than the upper limits with respect to the alloy dispersing particles, the plating layer has such a large thickness that it is unpreferable economically. In particular, it is further preferable that the plating layer includes either Sn in an amount of from 2.0 to 10.0% by weight or Ni in an amount of 2.0 to 8.0% by weight with respect to the alloy dispersing particles.

Requirement on Dispersibility: The metallic dispersing particles need to disperse uniformly in the low melting point Sn alloy matrix when they are added to and mixed with the molten matrix. The aforementioned wettability is associated with a what-is-called "conforming ability" of the metallic dispersing particles after they are added to and mixed with the matrix. On the contrary, the dispersibility hereinafter described is a property of the metallic dispersing particles to what extent they are added to and mixed with the molten low melting point Sn alloy satisfactorily. In order to achieve the satisfactory dispersibility, the outer peripheral surface of the Fe—C alloy dispersing particles and/or the Fe—W—C alloy dispersing particles with the Sn or Ni plating layer formed need to be subjected to a flux coating so as to improve the dispersibility.

The present inventors investigated a large variety of fluxes for the flux coating. As a result, they found that a flux including $ZnCl_2 \cdot NH_4Cl$ flux is satisfactory, and that the flux is preferably deposited on the outer peripheral surface of the Fe—C alloy dispersing particles and/or the Fe—W—C alloy dispersing particles with the Sn or Ni plating layer formed in a thickness of from 0.18 to 0.78 micrometers. For instance, when the flux is deposited hereon in a thickness of less than 0.18 micrometers, the alloy dispersing particles with the plating layer formed cannot be dispersed in the matrix satisfactorily. On the other hand, when the flux is deposited thereon in a thickness of more than 0.78 micrometers, it takes a long time to evacuate the gases, which generate when the alloy dispersing particles with the plating layer formed are charged into the matrix, so that it is unpreferable economically. In particular, it is further preferable to deposit the flux on the alloy dispersing particles with the plating layer formed in a thickness of from 0.30 to 0.60 micrometers.

In the present composite material, the metallic dispersing particles are dispersed in the matrix in an amount of from 10 to 50% by volume. The content of the metallic dispersing particles is limited to fall in the range in accordance with the following reasons. For instance, as illustrated with the blank circles and the solid curve in FIG. 3, when producing a pressing die by using the present composite material by casting, the present composite material including the metallic dispersing particles in the content range exhibits a good flowing ability, and the resulting pressing die is superior in the anti-wear property. In addition, when the present composite material contains the metallic dispersing particles in an amount of less than 10% by volume, the present composite material exhibits a good flowing ability, but it is inferior in the anti-wear property. On the other hand, when the present composite material contains the metallic dispersing particles in an amount of more than 50% by volume, the present composite material is superior in the anti-wear property, but it exhibits a deteriorated flowing ability. In particular, it is further preferable that the metallic dispersing particles are dispersed in the matrix in an amount of from 20 to 45% by volume.

However, the present inventors noticed that there is a slight specific gravity difference between the low melting point Sn alloy (i.e., the matrix) and the Fe alloy dispersing particles (i.e., the reinforcing particles) in the present composite material, and that there is exhibited a slightly insufficient wettability between the molten low melting point Sn alloy and the Fe allay dispersing particles.

As a result, when producing, for example, a pressing die with the present composite material by casting, the Fe alloy dispersing particles might separate from the low melting point Sn alloy matrix during the manufacturing process, and accordingly they might segregate to disperse unevenly in the matrix. Further, the resulting segregations might involve blowholes. All in all, the completed pressing die might have varying hardness at the portions, thereby exhibiting fluctuating anti-wear property.

Therefore, the present inventors determined to further reduce the specific gravity difference between the matrix and the metallic dispersing particles (i.e., the reinforcing particles) in the present composite material, and to enhance the wettability therebetween, thereby providing a modified version of the present composite material in which the reinforcing particles are dispersed further uniformly in the matrix and whose anti-wear property scarcely fluctuates.

The modified version of the present composite material comprises:

a matrix of a low melting point Sn alloy having a melting point of from 80° to 280° C.; and at least one member selected from the group consisting of intermetallic compound including Fe and Sn, and mixtures of the intermetallic compound and Fe alloy dispersing particles dispersed in the matrix in an amount of from 10 to 70% by volume.

In the modified present composite material, the aforementioned low melting point Sn alloys can be employed as well. In addition to the low melting point Sn alloys described above, the low melting point Sn alloy can be a Bi—Sn alloy whose Sn content is increased larger than the eutectic point so as to approximate its specific gravity to that of the Fe alloy dispersing particles, thereby inhibiting the segregation, which results from the specific gravity difference between the matrix and the reinforcing particles, during the melting or the casting process. Further, when the liquid phase and the solid phase of the matrix coexist, the reinforcing particles can be readily mixed with the matrix. Hence, the low melting point Sn alloy can be a Bi—Sn alloy to which Sb is added so as to produce the coexistence of the liquid phase and the solid phase and to simultaneously effect the solid solution hardening or strengthening during the melting or the casting process.

The intermetallic compound including Fe and Sn or the mixtures of the intermetallic compound and the Fe alloy dispersing particles are dispersed in the matrix, thereby reinforcing or strengthening the matrix. They are dispersed in the matrix in the amount of from 10 to 70% by volume, preferably in an amount of from 25 to 55% by volume, because the resulting modified present composite material has a favorable molten metal flowing ability when they are made into castings by casting, and the resulting castings exhibit a good anti-wear property. In addition, the mixture preferably contains the intermetallic compound in an amount of from 10 to 50% by weight, and the Fe alloy dispersing particles in an amount of from 0 to 50% by weight.

In the case that the intermetallic compound or the mixtures are dispersed in the matrix in an amount of less than 10% by volume, the resulting composite materials have a good molten metal flowing ability when they are melted to pour, but they make castings having a degraded anti-wear property. In the case that they are dispersed therein in an amount of more than 70% by volume, the resulting composite materials make castings having a favorable anti-wear property, but they have a degraded molten metal flowing ability when they are melted to pour, and accordingly they can be hardly molded by casting.

In the modified present composite material, the intermetallic compound including Fe and Sn can be not only FeSn but also $Fe_3Sn$, $Fe_3Sn_2$ and $FeSn_2$, and the Fe alloy dispersing particles can be the aforementioned Fe alloy dispersing particles which have been described in detail.

As having been described so far, the modified present composite material comprises the matrix of the low melting point Sn alloy, and at least one member selected from the group consisting of the intermetallic compound including Fe and Sn, and the mixtures of the intermetallic compound and the Fe alloy dispersing particles dispersed in the matrix in the amount of from 10 to 70% by volume. Since the intermetallic compound including Fe and Sn has a specific gravity similar to that of the low melting point Sn alloy, and since they exhibit a high wettability to the matrix, the intermetallic compound can be dispersed in the matrix uniformly without causing the segregations. Even when the mixtures are used, the intermetallic compound can fill between the Fe alloy dispersing particles, because it has the high wettability to the low melting point Sn alloy and it is capable of uniformly dispersing therein. Accordingly, the Fe alloy dispersing particles can be uniformly dispersed favorably. Hence, the modified present composite material is homogeneous without exhibiting the fluctuating anti-wear properties at the portions, and thereby it is superb in the anti-wear property and the mechanical properties.

Likewise, when the modified present composite material is melted, poured into the mold, cooled and hardened, the solid state intermetallic compound and the Fe alloy dispersing particles, dispersed in the molten composite material, do not solidify and shrink, and thereby there arise, in a lesser degree, the adverse effects of the distortions which result from the solidification and shrinkage of the molten composite material. Therefore, the resulting pressing die is highly accurate.

A process for producing the present composite material will be hereinafter described. The process comprises the steps of:

preparing metallic dispersing particles; and adding the metallic dispersing particles to a molten low melting point Sn alloy having a melting point of from 80° to 280° C. in an amount of from 10 to 50% by volume.

Further, the process can further include the step of electroplating an Sn or Ni plating layer on outer peripheral surface of the metallic dispersing particles in order to improve the wettability of the metallic dispersing particles to the molten low melting point Sn alloy. Furthermore, the process can furthermore include the step of immersing the metallic dispersing particles with the plating layer formed into a $ZnCl_2 \cdot NH_4Cl$ flux in order to enhance the dispersibility of the metallic dispersing particles in the molten low melting point Sn alloy, and the step of vacuum-drying the metallic dispersing particles with the flux deposited.

For example, a process for preferably producing the present composite material comprises the steps of:

electroplating a plating layer including either Sn or Ni on outer peripheral surface of at least one of the Fe—C alloy dispersing particles and the Fe—W—C alloy dispersing particles having a substantial sphere shape with a particle diameter of from 10 to 1,000 micrometers with an electric current density of from 0.5 to 5.0 $A/dm^2$ in an Sn amount of from 1 to 15% by weight or in an Ni amount of from 1 to 10% by weight with respect to at least one of the Fe—C alloy dispersing particles and the Fe—W—C alloy dispersing particles;

immersing at least one of the Fe—C alloy dispersing particles and the Fe—W—C alloy dispersing particles with the plating layer formed into a $ZnCl_2 \cdot NH_4Cl$ flux so as to deposit the flux on outer peripheral surface of at least one of the Fe—C alloy dispersing particles and the Fe—W—C alloy dispersing particles with the plating layer formed in a thickness of from 0.18 to 0.78 micrometers;

vacuum-drying at least one of the Fe—C alloy dispersing particles and the Fe—W—C alloy dispersing particles with the flux deposited; and adding at least one of the Fe—C alloy dispersing particles and the Fe—W—C alloy dispersing particles with the flux deposited to a molten low melting point Sn alloy having a melting point of from 80° to 280° C. in an amount of from 10 to 50% by volume.

In order to preferably produce the present composite material, at least one of the Fe—C alloy dispersing particles and the Fe—W—C alloy dispersing particles having a substantial sphere shape with the particle diameter of from 10 to 1,000 micrometers are prepared at first by atomizing or by reducing iron ore, or the like. Then, the electric plating is carried out on the outer peripheral surface of the Fe—C alloy dispersing particles and/or the Fe—W—C alloy dispersing particles with the electric current density of from 0.5 to 5.0 $A/dm^2$ so that the plating layer is formed in the Sn amount of from 1 to 15% by weight or in the Ni amount of from 1 to 10% by weight with respect to the Fe—C alloy dispersing particles and/or the Fe—W—C alloy dispersing particles by the methods set forth in Japanese Unexamined Patent Publication (KOKAI) No. 1-149,902, Japanese Unexamined Patent Publication (KOKAI) No. 1-272,792, Japanese Unexamined Patent Publication (KOKAI) No. 3-2,392 and Japanese Unexamined Patent Publication (KOKAI) No. 3-2,393, e.g., an inclined barrel plating process, a vertical suspension plating process, or the like.

When the plating layer is formed of Sn, the plating operation can be carried out by using a neutral aqueous solution of an organic tin carboxylate as the plating solution. When the plating layer is formed of Ni, the plating operation can be carried out by using an ordinary temperature bath for nickel plating which comprises nickel sulfate, ammonium chloride and boric acid. When the plating operation is carried out with an electric current density of less than 0.5 $A/dm^2$, such a plating operation is not preferable because of the growing possibility that there arise non-plated portions on the Fe—C alloy dispersing particles and/or the Fe—W—C alloy dispersing particles. On the other hand, when the plating operation is carried out with an electric current density of more than 5.0 $A/dm^2$, such a plating operation is not preferable because the electric current efficiency deteriorates at the anode and the cathode. In particular, it is further preferable that the alloy dispersing particles are electroplated with an electric current density of from 0.5 to 4.0 $A/dm^2$.

The Fe—C alloy dispersing particles and/or the Fe—W—C alloy dispersing particles are thus electroplated with the plating layer in the predetermined Sn or Ni amount with respect to the alloy dispersing particles, and they can be immersed into the $ZnCl_2 \cdot NH_4Cl$ flux so as to deposit the flux hereon in the thickness of 0.18 to 0.78 micrometers. For instance, the $ZnCl_2 \cdot NH_4Cl$ flux comprises 16.4% by weight of $ZnCl_2$, 3.0% by weight of $NH_4Cl$ and 80.6% by weight of $H_2O$, and it is diluted to a diluted solution with a dilution rate of from 6/10 to 10/10. After the immersion, they can be vacuum-dried.

The thus prepared Fe—C alloy dispersing particles and/or the Fe—W—C alloy dispersing particles are added to and stirred with the low melting point Sn alloy which is heated and melted, for instance, at a temperature of from 220° to 280° C., in an amount of from 10 to 50% by volume with respect to the low melting point Sn alloy, and thereby they are fully mixed with and dispersed in the alloy. For example, the low melting point Sn alloy includes a Bi—Sn alloy, and its melting point is 220° C. at the highest. When the temperature of the melted alloy is set at less than 220° C. during the addition of the alloy dispersing particles, it is not preferable because the inferior flowing ability of the melted alloy makes the alloy dispersing particles hard to disperse therein. On the other hand, when the temperature of the melted alloy is set at more than 280° C. during the addition of the alloy dispersing particles, it is not preferable because the melted alloy starts to oxidize so as to deteriorate the quality of the composite material.

As having been described earlier, when the alloy dispersing particles are added to the alloy in an amount of less than 10% by volume, the advantageous effect, e.g., the improvement of the anti-wear property of the composite material, cannot be obtained fully because the addition amount of the alloy dispersing particles is too less. On the other hand, when the alloy dispersing particles are added to the alloy in an amount of more than 50% by volume, it is hard to carry out casting with the composite material because the flowing ability of the composite material deteriorates when melted.

When the predetermined amount of the Fe—C alloy dispersing particles and/or the Fe—W—C alloy dispersing particles are added to and stirred with the melted low melting point Sn alloy whose temperature is held in the temperature range, there arise gases, which results from the vaporized flux constituting the outermost layer of the alloy dispersing particles, and air, which was mingled with the melted alloy together with the alloy dispersing particles. Accordingly, it is preferable to carry out the step of degasing by further heating, melting and stirring the alloy together with the alloy dispersing particles added at a temperature of from 340°to 500° C. in vacuum whose vacuum degree is maintained at 0.01 Torr or less for 2 hours or more, thereby removing the gases and the air from the mixture.

In the degasing step, the vacuum degree is maintained at 0.01 Torr or less because not only the low melting point Sn alloy but also the Fe—C alloy dispersing particles and the Fe—W—C alloy dispersing particles are likely to be oxidized during the heating, melting and stirring process in vacuum whose vacuum degree is maintained at more than 0.01 Torr. Further, the temperature is set at from 340° to 500° C. because the boiling point of the $ZnCl_2 \cdot NH_4Cl$ flux is 340° C. at the highest. Namely, when the mixture is heated and stirred at 340° C. at least for 2 hours or more, the degasing of the gases resulting from the flux can be completed securely. On the contrary, when the mixture is heated at more than 500° C., Sn and the other components are likely to be vaporized considerably, which is not preferable. Furthermore, the degasing step is carried out for 2 hours or more because the present inventors found from a wide variety of experiments that the gases and the air are degased insufficiently for less than 2 hours.

After the degasing step is completed, the composite material is cooled while maintaining the vacuum degree. Then, the vacuum is put back to the atmospheric pressure, and thereafter the present composite material is used for casting. For instance, when the low melting point Sn alloy is a Bi—Sn alloy, the Bi—Sn alloy with the Fe—C alloy dispersing particles and/or the Fe—W—C alloy dispersing particles added is cooled to a temperature of from 220° to 280° C. while maintaining the vacuum degree, thereby inhibiting the molten alloy from being oxidized. Then, the present composite material is cast into shapes after it is placed under the atmospheric pressure. The mixture is cooled at a temperature of from 220° to 280° C. because of the following reasons. When the vacuum is canceled at a temperature of more than 280° C., the molten low melting point Sn alloy is likely to be oxidized. On the contrary, when the molten mixture is cooled at a temperature of less than 200° C., it exhibits such an inferior flowing ability that it is hard to be cast into shapes.

When the cast substances become useless, they can be heated and melted at a temperature of from 220° to 280° C. in air, and thereafter they can be cast for storage by injecting them into a mold. Thus, the present composite material has a satisfactory recycling ability.

However, the present inventors found that the molten low melting point Sn alloy does not satisfactorily show a high wettability to the metallic dispersing particles, especially to the Fe alloy dispersing particles. They also noticed that the heated and melted low melting point Sn alloy and the Fe alloy dispersing particles added thereto are likely to be oxidized, and that oxide films are likely to be formed on the surface of the Fe alloy dispersing particles. Accordingly, during the aforementioned production process, namely when stirring and dispersing the Fe alloy dispersing particles in the molten low melting point Sn alloy, the low melting point Sn alloy and the Fe alloy dispersing particles are likely to separate from each other, and blowholes might be involved in the thus segregated Fe alloy dispersing particles, thereby causing failures. Moreover, the Fe alloy dispersing particles may not be dispersed in the molten low melting point Sn alloy fully uniformly, thereby inhibiting homogeneous composite materials from being produced.

Hence, the present inventors decided to modify the process in order to solve the shortcomings associated therewith. Modified versions of the process can disperse the metallic dispersing particles in the low melting point Sn alloy fully uniformly so as to improve the anti-wear property of the composite material, they can eliminate the failures resulting from the blowholes involved therein, and they can produce homogeneous composite materials.

A modified version of the process comprises the steps of:

preparing a mixed powder by mixing a low melting point Sn alloy powder having a melting point of from 80° to 280° C. with coated particles, the coated particles prepared by forming either an Sn or Ni plating layer on outer peripheral surface of Fe alloy dispersing particles having a substantial sphere shape with a particle diameter of 10 to 1,000 micrometers, and followed by forming an oxidation inhibitor layer on outer peripheral surface of the plating layer;

heating the mixed powder to a temperature of the melting point or more of the low melting point Sn alloy powder; and casting the molten low melting point Sn alloy mixed with the Fe alloy dispersing particles.

In the modified process, the aforementioned low melting point Sn alloys can be employed as well, and they can be formed into the low melting point Sn alloy powder, for instance, by atomizing. The average particle diameter and configuration of the Sn alloy powder are not restricted herein specifically. In addition, it is especially preferable to employ a low melting point Bi—Sn eutectic alloy powder with Sb added in an amount of 10% by weight or less, because the addition of Sb further improves the anti-wear property and mechanical properties of the resulting present composite material.

Likewise, in the modified process, the aforementioned Fe alloy dispersing particles can be employed as well. Due to the reasons as set forth above, it is preferred that they are added in the amount of from 10 to 50% by volume, preferably in the amount of from 20 to 45% by volume, with respect to the low melting point Sn alloy powder. Further, in order to uniformly distribute them in the Sn alloy powder, they are also required to meet the aforementioned requirement on the particle diameter of the metallic dispersing particles.

In the modified process, it is necessary to subject the Fe alloy dispersing particles to the plating and the flux-depositing. The plating and the flux-depositing can be carried out in the same manner as earlier described.

In particular, in the modified process, the flux-depositing is carried out onto the Sn or Ni plating layer in order to purify oxidation films on the plating layer and the low melting point Sn alloy powder and to inhibit the plating layer and the Sn alloy powder from oxidizing. In addition to the $ZnCl_2 \cdot NH_4Cl$ flux, an aqueous 10% HCl solution, a sparkle flux for soldering or the like can be employed preferably. The $ZnCl_2 \cdot NH_4Cl$ flux can comprise $ZnCl_2$ in an amount of from 13 to 19% by weight, $NH_4Cl$ in an amount of from 1 to 8% by weight and $H_2O$ in an amount of from 75 to 85% by weight, and it is diluted with the same dilution rate as earlier mentioned.

Also in the modified process, the oxidation inhibitor flux layer is required to satisfy the aforementioned thickness requirement on the $ZnCl_2 \cdot NH_4Cl$ flux layer. Namely, when it is deposited thereon in a thickness of less than 0.18 micrometers, the oxidation cannot be inhibited fully. On the other hand, when it is deposited thereon in a thickness of more than 0.78 micrometers, it uneconomically takes such a long time to evacuate the gases in the step of heating the mixed powder.

In the modified process, the coated particles can be dispersed uniformly in the molten low melting point Sn alloy by heating the mixed powder of the Sn alloy powder and the coated particles to the temperature of the melting point or more of the Sn alloy powder. Thereafter, the molten Sn alloy with the coated particles dispersed uniformly is charged into a mold to carry out casting. In particular, it is preferred that the mixed powder is heated and melted at a temperature of 280° C. or less in vacuum or an inert gas atmosphere. However, in the modified process, it is not always necessary to carry out the step of heating in vacuum or the like, because the flux layer deposited on the coated particles can fully inhibit the oxidation.

In the modified process, in order to inhibit the gases associated with the vaporized flux layer and the air in the atmosphere from involving in the resulting composite materials, it is preferred to carry out the degasing step in an enclosed container under the same conditions, for example, at the temperature of from 340° to 500° C. in the vacuum of 0.01 Torr or less for 2 hours or more.

In the modified process, in order to inhibit the low melting point Sn alloy from oxidizing, it is also preferred to carry out, after the degasing step, the step of cooling the molten Sn alloy with the Fe alloy dispersing particles dispersed under the same conditions, for instance, to the temperature of 280° C. or less while maintaining the vacuum degree, and thereafter to carry out, after canceling the vacuum, the step of casting.

The present composite material produced in accordance with the modified process can be recycled by heating and melting it again in air, preferably at a temperature of 280° C. or less in vacuum, and thereafter by casting it for storage. During the recycling, the Fe alloy dispersing particles are less likely to dissolve and diffuse into the molten low melting point Sn alloy. Accordingly, the resulting present composite material can be improved in the hardness, the anti-wear property or the like. Further, there is formed intermetallic compound such as $FeSn_2$ or the like on the surface of the Fe alloy dispersing particles. The intermetallic compound securely gives the Fe alloy dispersing particles wettability with respect to the low melting point Sn alloy matrix. Consequently, it is possible to satisfactorily disperse the Fe alloy dispersing particles in the low melting point Sn alloy during the re-melting. Although the flux vaporizes and disappears, the Fe alloy dispersing particles have been already dispersed in the low melting point Sn alloy matrix. As a result, there is no fear for oxidizing the Fe alloy dispersing particles in the surface.

In the modified process for producing the composite material, the low melting point Sn alloy powder and the coated particles (i.e., reinforcing materials) having a predetermined particle diameter are mixed to prepare the mixed powder, and thereafter the mixed powder is heated to the temperature of the melting point or more of the low melting point Sn alloy powder to carry out casting. Hence, in accordance therewith, the low melting point Sn alloy powder and the coated particles can be mixed with each other readily and fully. As a result, when the mixed powder is heated to the temperature of the melting point or more of the low melting point Sn alloy powder so as to melt the low melting point Sn alloy, it is possible to disperse the coated particles in the molten low melting point Sn alloy extremely uniformly, compared with the case where the reinforcing particles or metallic dispersing particles are simply added to, stirred in and mixed with the heated and melted low melting point Sn alloy.

Further, the coated particles comprise the Fe alloy dispersing particles. The Fe alloy dispersing particles have a substantial sphere shape with the predetermined particle diameter, they have a small specific gravity difference with respect to the low melting point Sn alloy, and they have either the Sn or Ni plating layer, which has a good wettability to the low melting point Sn alloy, on the outer peripheral surface. With these arrangements, the coated particles can be dispersed in the molten low melting point Sn alloy extremely uniformly.

Furthermore, the coated particles have the oxidation inhibitor flux layer on the outer peripheral surface of the plating layer. The flux layer works not only to purify the oxide films which are formed on the surface of the low melting point Sn alloy powder and the coated particles but also to inhibit them from oxidizing. With this arrangement, the coated particles can be dispersed in the molten low melting point Sn alloy extremely uniformly.

Moreover, since the coated particles are dispersed in the molten low melting point Sn alloy extremely uniformly, the coated particles can be inhibited from segregating. Consequently, the blowholes can be securely inhibited from involving in the segregating coated particles.

All in all, in accordance with the modified process, it is possible to produce the present composite material in which the Fe alloy dispersing particles are uniformly dispersed and whose anti-property is accordingly improved more with the Fe alloy dispersing particles.

As having been described so far, the modified process comprises the steps of mixing the low melting point Sn alloy powder and the predetermined coated particles, thereby preparing the mixed powder, and heating the mixed powder to the temperature of the melting point of the low melting point Sn alloy powder or more, thereby casting the mixed powder. As a result, the reinforcing material of the coated particles can be dispersed in the matrix of the low melting point Sn alloy fully and uniformly, and thereby the homogeneous composite material can be produced.

In the modified process, since the low melting point Sn alloy serves as the matrix, it is advantageous to employ the modified process in order to reduce the time and costs required for production.

In the modified process, since the coated particles are employed which exhibit the small specific gravity difference with respect to the matrix of the low melting point Sn alloy and on which the Sn or Ni plating layer improving the wettability to the matrix and the oxidation inhibitor flux layer are provided, the arrangements of the coated particles help advantageously to disperse the coated particles further uniformly and they can securely inhibit the blowholes, resulting in the defective castings, from generating.

A further modified version of the process comprises the steps of:

preparing coated particles by forming either an Sn or Ni plating layer on outer peripheral surface of Fe alloy dispersing particles having a substantial sphere shape with a particle diameter of from 10 to 1,000 micrometers; and stirring and mixing the coated particles in a molten low melting point Sn alloy having a melting point of from 80° to 280° C. melted at a temperature of the melting point thereof or more in vacuum; and casting the molten low melting point Sn alloy mixed with the the Fe alloy dispersing particles.

A furthermore modified version of the process comprises the steps of:

preparing coated particles by forming either an Sn or Ni plating layer on outer peripheral surface of Fe alloy dispersing particles having a substantial sphere shape with a particle diameter of from 10 to 1,000 micrometers; and heating a low melting point Sn alloy having a melting point of from 80° to 280° C. to a partially molten state;

stirring and mixing the coated particles in the partially molten low melting point Sn alloy; and casting the partially molten low melting point Sn alloy mixed with the Fe alloy dispersing particles.

In the further and furthermore modified processes, the aforementioned low melting point Sn alloys can be employed as well.

Likewise, in the further and furthermore modified processes, the aforementioned Fe alloy dispersing can be employed for producing the coated particles. Further, in order to uniformly distribute the coated particles in the low melting point Sn alloy, they are required to meet the aforementioned requirements on the particle diameter and configuration of the metallic dispersing particles.

However, in the further and furthermore modified processes, it is necessary to subject the Fe alloy dispersing particles to the plating. The plating can be carried out in a manner identical with that of the process earlier described.

Due lo the reasons set forth above, it is preferred that the coated particles are added in the amount of from 10 to 50% by volume, preferably in the amount of from 20 to 45% by volume, with respect to the low melting point Sn alloy.

In accordance with the further modified process, the coated particles are stirred and mixed in the molten low melting point Sn alloy melted at the temperature of the melting point thereof or more in vacuum.

Then, the coated particles are stirred and mixed in the fully molten low melting point Sn alloy melted in vacuum in order to inhibit the coated particles and the low melting point Sn alloy from oxidizing. In view of this, it is preferable to set a vacuum degree to 0.01 Torr or less.

After the coated particles are stirred and mixed in the molten low melting point Sn alloy in vacuum, the temperature of the resulting mixture can be maintained at the melting point of the low melting point Sn alloy or more, and the atmospheric pressure can be recovered. Then, the mixture can be cast into predetermined shapes. During the operations, it is preferable to cool the mixture to a temperature of 280° C. or less and thereafter to recover the atmospheric pressure in order to inhibit the Fe alloy dispersing particles and the low melting point Sn alloy from oxidizing.

In the furthermore modified process, in order to produce the partially molten state during the stirring and mixing the coating particles, it is necessary to employ low melting point Sn alloys in which the weight ratios between the 2 metallic components forming the alloys are set at other than the eutectic point.

In the furthermore modified process, in order to have the solid phase low melting point Sn alloy capture and hold the coated particles, the coated particles are stirred and mixed in the partially molten low melting point Sn alloy. Accordingly, it is possible to inhibit the coated particles from floating or sedimenting. The partially molten low melting point Sn alloy herein means that the low melting point Sn alloy exists in coexisting two phases, the liquid phase and the solid phase.

For instance, the low melting point Sn—Bi alloy provides the partially molten state in the hatched regions of FIG. 8. Namely, the low melting point Sn—Bi alloy exists in the coexisting two phases, the liquid phase and the solid phase (e.g., L+beta-Sn or L+Bi). In FIG. 8, the area designated with "L" is the liquid phase, the area designated with "beta-Sn" is the solid phase, and the area designated with "beta-Sn+Bi" is the coexisting two solid phases. Specifically speaking, in the phase diagram of the low melting point Sn—Bi alloy, when the composition of the alloy is expressed by a formula, 72% by weight Sn-28% by weight Bi, the alloy provides the partially molten state at a temperature of about 140–180° C. moreover, the alloy having the same composition contains the liquid chase and the solid phase in a ratio of the line segment AB to the line segment BC of FIG. 8, i.e., the liquid phase: the solid phase=AB:BC, when it is heated to 170° C. Namely, when the low melting point Sn—Bi alloy lies in the regions where it provides the partially molten state, the ratio of the solid phase decreases if the weight ratio between the two metallic components approaches the eutectic point at a constant temperature, or it decreases if the temperature is raised at a constant composition.

When stirring and mixing the coated particles in the partially molten low melting point Sn alloy, it is preferred that the ratio of the liquid phase:the solid phase falls in a range of from 2:1 to 1:2 therein. When the ratio of the solid phase falls outside the smallest range, the advantageous effect of the capturing and holding the coated particles by the solid phase is effected insufficiently. When the ratio of the solid phase is decreased less than the ratio by bringing the composition close to the eutectic point, the low melting point Sn alloy is turned from the partially molten state to a sole liquid state by a slight temperature increment. Hence, if such is the case, it is hard to set the temperature condition. On the other hand, when the ratio of the solid phase falls outside the largest range, the flowing ability degrades so that it is difficult to fully stir and mix the coated particles. For example, when the composition of the low melting point Sn alloy is at a point furthest away from the eutectic point (e.g., the point "D" of FIG. 8) where the partially molten state can be maintained at the eutectic temperature, and when the ratio of the solid phase is decreased less than the ratio by bringing the composition further away from the eutectic point, the low melting point Sn alloy is turned from the partially molten state to a sole solid state by a slight temperature decrement resulting from the addition of the coated particles or the like. Hence, if such is the case, it is also hard to set the temperature condition. In view of these, in the case that the low melting point Sn—Bi alloy is employed as the low melting point Sn alloy, when stirring and mixing the coated particles in the partially molten state, it is preferred that the Sn—Bi alloy contains Bi in an amount of from 20 to 40% by weight.

In the furthermore modified process, it is possible to carry out the stirring and mixing the coated particles in the partially molten low melting Sn alloy, which is heated to hold the state, either in air or in vacuum. It is preferable, however, to carry out the process in vacuum in order to inhibit the plating layer of the coated particles from oxidizing. It is further preferable to set a degree of vacuum at 0.01 Torr or less.

In the furthermore modified process, after stirring and mixing the coated particles in the partially molten low melting Sn alloy which is heated to hold the state, it is possible to carry out casting while maintaining the same temperature. In view of the molten metal flowing ability, it is preferable to carry out casting after further heating the mixture so as to increase the fluidity. In addition, in order to lower the melting point and reduce the shrinkage during solidifying, it is preferable to make the composition of the low melting point Sn alloy close to the eutectic point by adding either one of the metallic components of the low melting point Sn alloy after stirring and mixing the coated particles in the partially molten low melting Sn alloy.

The composite material produced in accordance with the further and furthermore modified processes can be recycled by casting after re-heating and re-melting it in air, preferably at a temperature of 280° C. or less in vacuum. During the recycling, it is possible to maintain the advantageous effects, e.g., the improvements in the hardness and the anti-wear property, resulting from the addition of the Fe alloy dispersing particles, because the Fe alloy dispersing particles are less likely to dissolve in and diffuse into the completely or partially molten state low melting point Sn alloy. Further, during the recycling, it is possible to favorably disperse the Fe alloy dispersing particles in the low melting point Sn alloy, because intermetallic compound such as $FeSn_2$ or the like is formed on the surface of the Fe alloy dispersing particles and they securely provide a wettability between the Fe alloy dispersing particles and the matrix of the low melting point Sn alloy.

Particularly, in accordance with the further modified process, the aforementioned coated particles (e.g., the Fe alloy dispersing particles having a substantial sphere shape with the predetermined particle diameter and coated with either an Sn or Ni plating layer exhibiting a satisfactory wettability to the Sn low melting point alloy) are stirred and mixed in vacuum in the molten low melting point Sn alloy melted at the temperature of the melting point thereof or more. Accordingly, the coated particles can be dispersed extremely uniformly in the molten low melting point Sn alloy.

Further, the coated particles are stirred and mixed in vacuum in the molten low melting point Sn alloy in vacuum. Consequently, the low melting point Sn alloy and the coated particles can be inhibited from oxidizing, and thereby the coated particles can be dispersed extremely uniformly in the molten low melting point Sn alloy.

By thus uniformly dispersing the coated particles in the low melting point Sn alloy, the coated particles can be inhibited from segregating, and thereby the blowholes are hardly involved in the segregation.

Especially, in accordance with the furthermore modified process, the aforementioned coated particles are stirred and mixed in the partially molten low melting point Sn alloy. Accordingly, the coated particles can be dispersed also extremely uniformly in the partially molten low melting point Sn alloy.

Namely, the solid phase low melting point Sn alloy can capture and hold the coated particles so as to inhibit the coated particles from floating or sedimenting, because the low melting point Sn alloy is in the partially molten state. Consequently, the Fe alloy dispersing particles can be dispersed extremely uniformly in the matrix of the low melting point Sn alloy.

Hence, in accordance with the further and furthermore modified processes, it is thus possible not only to produce the present composite material whose anti-wear property is improved by the Fe alloy dispersing particles, but also to uniformly disperse the Fe alloy dispersing particles so as to make the present composite material homogeneous.

The present composite material provides advantageous effects as follows. In the present composite material, the specific gravity difference between the low melting point Sn alloy constituting the matrix and the metallic dispersing particles are so small that the metallic dispersing particles hardly segregate in the matrix. Namely, the composite material is superior in the anti-wear property because the metallic dispersing particles which are employed for reinforcement is uniformly dispersed in the matrix.

In particular, when a pressing die is made from the present composite material by casting and it is used for pressing galvanized steel sheets, the pressing die exhibits a dynamic friction coefficient which is reduced by about $^{43}$% with respect to those which are exhibited by pressing dies made from Conventional Example Alloy Nos. 1 and 2. Accordingly, the pressing die made from the present composite material exhibits an anti-wear property which is enhanced by the same factor.

The reason for the advantageous effect is believed to be as follows. The specific gravity difference between the matrix, i.e., the low melting point Sn alloy, and the metallic dispersing particles dispersed in the matrix is so small that the metallic dispersing particles are dispersed substantially uniformly in the matrix without being segregated. The present composite material has a good affinity to the galvanized steel sheets to be pressed. The matrix is softer than the metallic dispersing particles so that the matrix works as a lubricant at contacts between the pressing die and the galvanized steel sheets where they are brought into contact with each other.

Hence, when using the pressing die made from the present composite material, the wears can be reduced at the contacts between the pressing die and the galvanized steel sheets without coating the pressing die with an oil or the like. As a result, it is possible to stabilize products qualities after pressing.

Further, since the present composite material includes the solid state metallic dispersing particles dispersed in the matrix in an amount of from 10 to 50% by volume, it has the improved flowing ability. When the present composite material is heated, melted and poured into a mold so as to make a rough pressing die by casting, it exhibits the molten metal flowing ability and the working ability satisfactorily during the pouring. In addition, there usually arise the adverse effects which result from the distortions caused by the solidification and shrinkage when a liquid state metal is cooled and hardened. However, even after the molten liquid state composite material is poured into the mold, cooled and hardened, there arise the adverse effects in a lesser degree because the solid state metallic dispersing particles dispersed in the matrix of the liquid state present composite material are not solidified and shrunk. Therefore, the resulting pressing die is highly accurate.

Furthermore, the present composite material is good in view of the recycling ability, and it is also advantageous in view of the cost, because the metallic dispersing particles dispersed in the matrix in an amount of from 10 to 50% by volume are not diffused therein so as to form solid solution and because they are less expensive.

As described earlier, the low melting point Sn alloy is satisfactory in view of the time and the cost required for producing a rough mold, such as a pressing die, an injection molding mold or the like, by casting, because of its low melting point. However, the low melting point Sn alloy, e.g., the binary eutectic alloy including Bi and Sn, suffers from the disadvantage, i.e., the inferior anti-wear property. The disadvantage can be overcome remarkably when the metallic dispersing particles of the present composite material include the Fe—C alloy dispersing particles and/or the Fe—W—C alloy dispersing particles, the plating layer formed on the outer peripheral surface of the alloy dispersing particles, and the flux deposited on the outer peripheral surface of the plating layer.

Namely, the metallic dispersing particles including the Fe—C alloy dispersing particles and/or the Fe—W—C alloy dispersing particles, the plating layer and the flux can be added favorably to the molten low melting point Sn alloy, because they have a specific gravity which is slightly smaller than that of the low melting point Sn alloy, and because the specific gravity can be adjusted to an optimum value depending on the compositions of the low melting point Sn alloy. The metallic dispersing particles are not only hard but also they can be electroplated in order to improve the wettability because of their carbon content. The metallic dispersing particles which have been used already can be melted and used in the manufacture of the rough mold for a plurality of times because they are not diffused in the low melting point Sn alloy so as to form solid solution. The metallic dispersing particles can be dispersed uniformly as soon as they are added to and mixed with the molten low melting point Sn alloy, and they exhibit a good flowing ability in the molten state. The wettability of the metallic dispersing particles with respect to the molten low melting point Sn alloy is secured because the plating layer is formed on the outer peripheral surface of the Fe—C alloy dispersing particles and/or Fe—W—C alloy dispersing particles. The dispersibility of the metallic dispersing particles with respect to the molten low melting point Sn alloy is also ensured because the flux is deposited on the outer peripheral surface of the plating layer.

The present process for preferably producing the present composite material which can overcome the disadvantage of the low melting point Sn alloy, e.g., the inferior anti-wear property, is a novel one. That is to say, the present process prescribes the requirements on the metallic dispersing particles for the present composite material, and it further specifies not only the preferable electric current density for electroplating the outer peripheral surface of the Fe—C alloy dispersing particles and/or the Fe—W—C alloy dispersing particles, but also the way how to dry the flux deposited on the outer peripheral surface of the plating layer.

The rough mold made from the present composite material is sharply improved in the anti-wear property, which can be readily appreciated from the following description on the preferred embodiments of the present composite material. Additionally, although the present composite material is based on the low melting point Sn alloy for the rough mold, for instance, the binary eutectic alloy including Bi and Sn, it can be re-used for a plurality of times without adversely affecting the sharply improved anti-wear property. The present invention provides the aforementioned advantageous effects, and accordingly it is considerably valuable industrially.

BRIEF DESCRIPTION OF THE DRAWINGS

A more complete appreciation of the present invention and many of its advantages will be readily obtained as the same becomes better understood by reference to the following detailed description when considered in connection with the accompanying drawings and detailed specification, all of which forms a part of the disclosure.

DETAILED DESCRIPTION OF THE PREFERRED EMBODIMENTS

Having generally described the present invention, a further understanding can be obtained by reference to the specific preferred embodiments which are provided herein for purposes of illustration only and are not intended to limit the scope of the appended claims.

First Preferred Embodiment

The First Preferred embodiment of the present composite material comprised a matrix of a low melting point Bi—Sn alloy, and Fe dispersing particles dispersed in the matrix in an amount of 45% by volume.

In particular, the matrix included a Bi—Sn low melting point alloy whose weight contents of Bi and Sn were set at the eutectic point, i.e., Bi:Sn=58:42, and Sb was added to the Bi—Sn low melting point alloy in an amount of 5% by weight.

The Fe dispersing particles were prepared by atomizing an Fe powder, and they had a sphere shape with an average particle diameter of from 200 to 300 micrometers.

Figure 1:
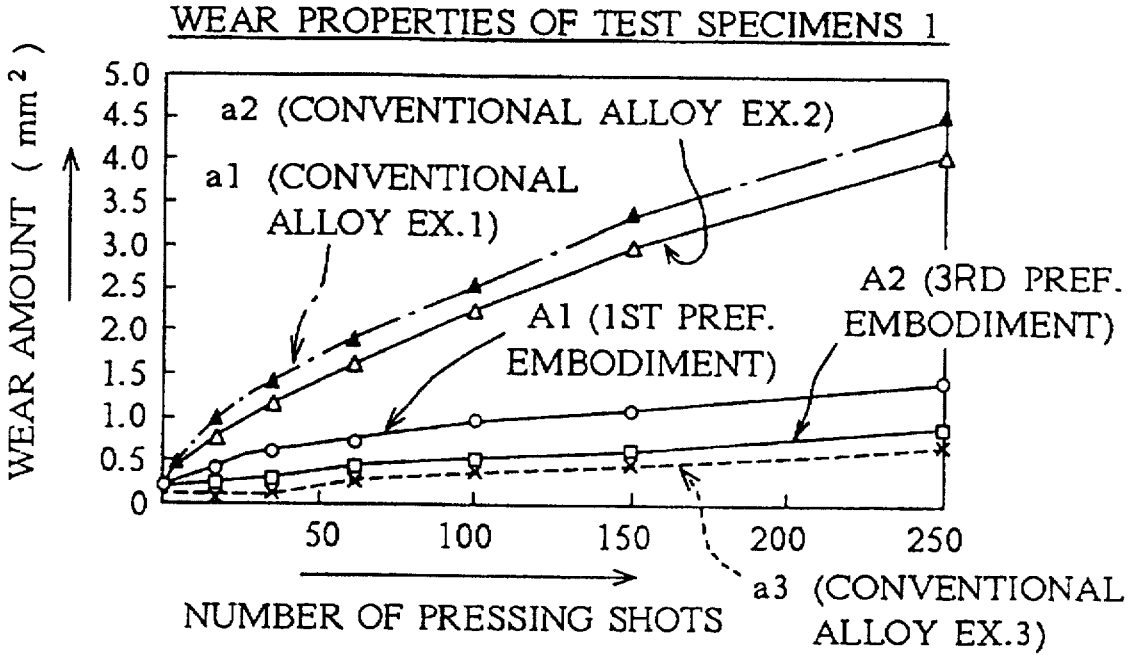
FIG. 1 is a graph for comparing the relationships between the number of pressing shots and the wear amounts exhibited by the test specimens made from First and Third Preferred Embodiments of the present composite material and the comparative test specimens made from Conventional Example Alloy Nos. 1 through 3 during a pressing operation with galvanized steel sheets, the graph whose axis of abscissa expresses the number of pressing shots and axis of ordinate expresses the wear amounts.
Figure 6:
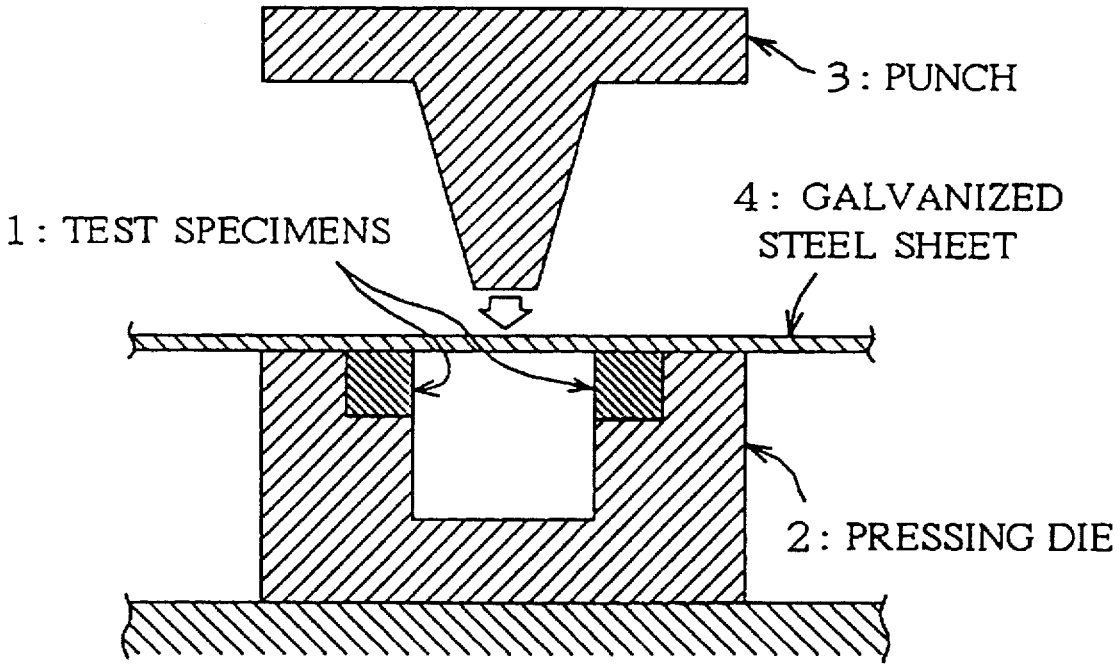
FIG. 6 is a schematic cross-sectional view for illustrating a testing apparatus which was adapted for carrying out the pressing operation, i.e., an anti-wear test, and included a punch and the pressing die with the test specimens made from the First through Six Preferred Embodiments installed.
Figure 7:
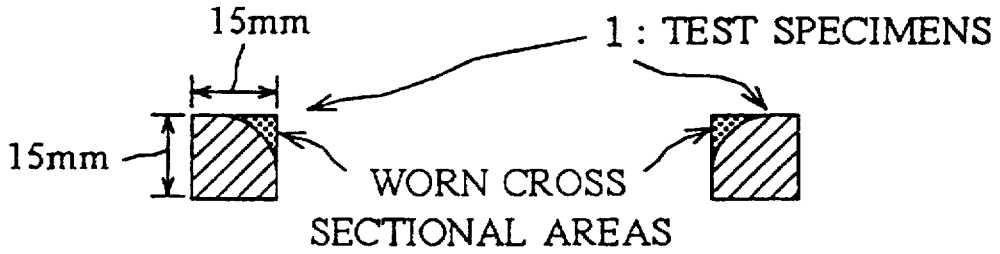
FIG. 7 is a schematic cross sectional view for illustrating the test specimens and the worn cross sectional areas after completing the anti-wear test.
Figure 8:
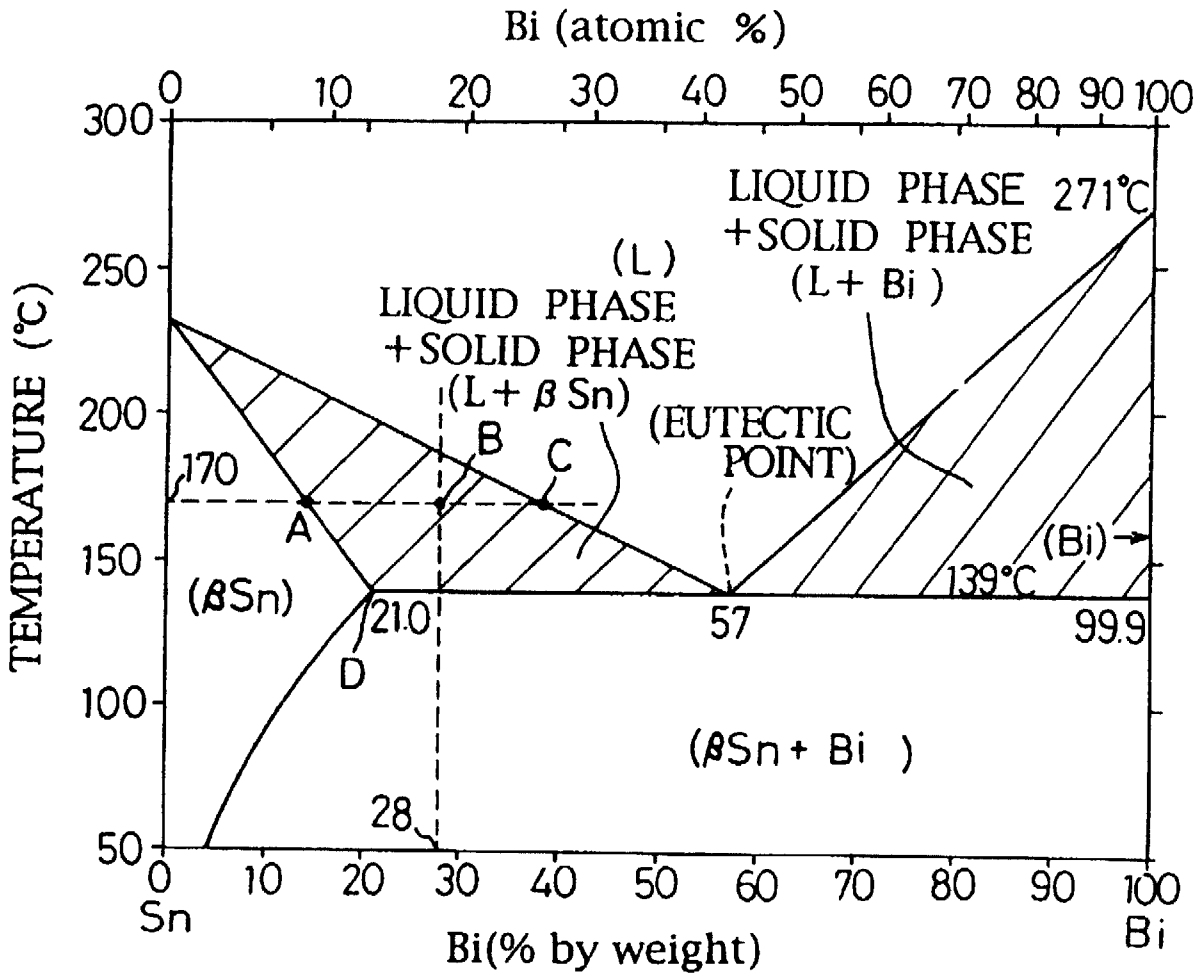
FIG. 8 is a phase diagram of the low melting point Sn—Bi alloy and designates the partially molten areas of the Sn—Bi alloy.

The test specimens 1 were prepared with the First Preferred Embodiment of the present composite material in a size of 15 mm in length ×15 mm in width ×120 mm in depth, i.e., a rectangular parallelepiped having a square shape in cross-section, as illustrated in FIGS. 6 and 7. During the preparation of the test specimens 1, the flowing ability of the First Preferred Embodiment was also examined. The test specimens 1 were installed to a die 2 on a pressing machine so as to make a pressing die. Then, a pressing operation was carried out onto a galvanized steel sheet 4 having a thickness of 1.6 mm with a punch 3 which could approach to the pressing die. After carrying out the pressing operation a predetermined number of pressing shots, the test specimens 1 were examined for evaluating the relationship between the number of pressing shots and the wear amounts in the test specimens 1, and the results of the evaluation are shown in FIG. 1. At the same time, the test specimens 1 were also examined for evaluating the relationship between the surface pressures (kgf/cm$^2$) and the dynamic friction coefficients (μ), and the results are shown in FIG. 2.

The results of the anti-wear test proved the following. Namely, the test specimens 1 made from the First Preferred Embodiment of the present composite material exhibited wear amounts as illustrated by "A1" curve of FIG. 1, and the wear amounts were reduced sharply with respect to those exhibited by the test specimens 1 made from Conventional Example Alloy Nos. 1 and 2 as illustrated by "a1" and "a2" curves of FIG. 1 respectively. Although the test specimens 1 made from Conventional Example Alloy No. 3 including Zn as the principle component had the best anti-wear property as illustrated by "a3" curve of FIG. 1, the test specimens 1 made from the First Preferred Embodiment had an anti-wear property similar to that of the test specimens 1 made from Conventional Example Alloy No. 3.

Figure 2:
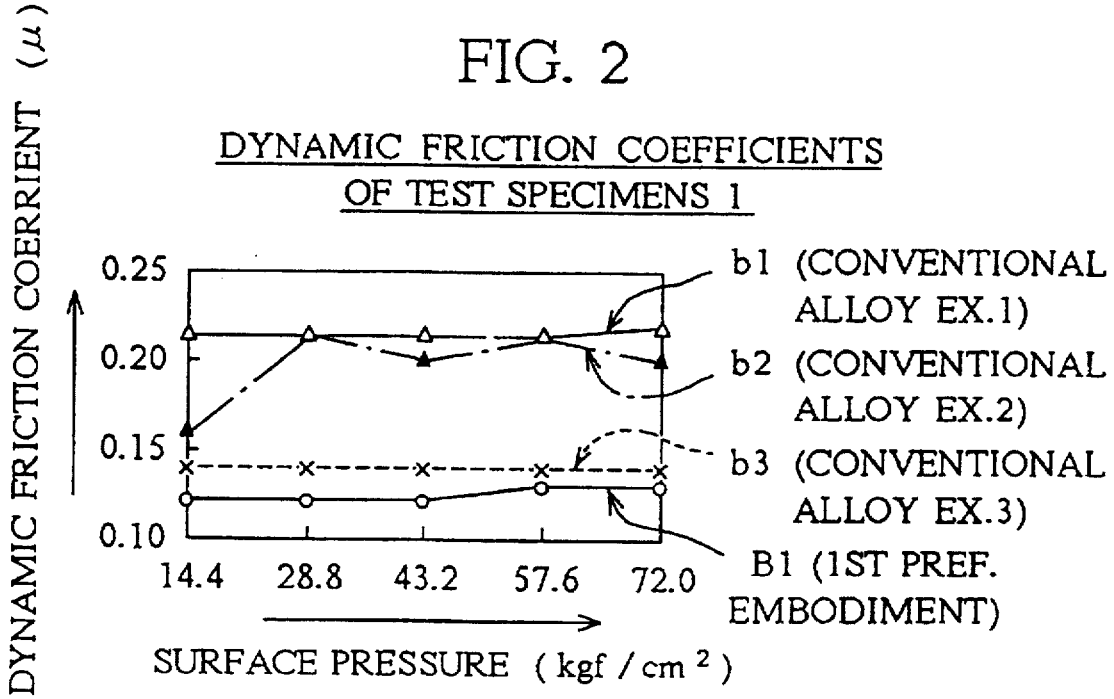
FIG. 2 is a graph for comparing the relationships between the surface pressures (kgf/cm$^2$) and the dynamic friction coefficients (μ) exhibited by the test specimens made from the First Preferred Embodiment and the comparative test specimens made from Conventional Example Alloy Nos. 1 through 3 during the pressing operation with the galvanized steel sheets, the graph whose axis of abscissa expresses the surface pressures and axis of ordinate expresses the dynamic friction coefficients.

As illustrated by "B1" curve (designated with solid lines and blank circles) of FIG. 2, the test specimens 1 made from the First Preferred Embodiment of the present composite material exhibited low dynamic friction coefficients (μ) of from 0.12 to 0.13 over surface pressures of from 14.4 to 72.0 kgf/cm$^2$. The low dynamic friction coefficients (μ) were reduced by about 43% with respect to those of the test specimens 1 made from Conventional Example Alloy No. 1 illustrated by "b1" curve of FIG. 2. The reason for the reduction is believed as follows. Namely, (a) the specific gravity difference between the low melting point Bi—Sn alloy constituting the matrix and the Fe dispersing particles dispersed in the matrix in the amount of 45% by volume is so small that the Fe dispersing particles are dispersed substantially uniformly in the matrix without segregating. (b) The test specimens 1 made from the First Preferred Embodiment has a good affinity to the galvanized steel sheets 4 to be pressed. (c) The matrix is softer than the Fe dispersing particles so that the matrix works as a lubricant at contacts between the test specimens 1 and the galvanized steel sheets 4 where they are brought into contact with each other.

Hence, when using the test specimens 1 made from the First Preferred Embodiment for the pressing die, the wears can be reduced at the contacts between the test specimens 1 and the galvanized steel sheets 4 without coating the contacts with a lubricant such as an oil or the like. As a result, it is possible to stabilize products qualities after pressing.

Further, since the Fe dispersing particles dispersed in the matrix in the amount of 45% by volume is less expensive, and since they are not diffused in the matrix so as to form solid solution, the First Preferred Embodiment can be recycled satisfactorily and it is advantageous in the cost.

Second Preferred Embodiment

The Second Preferred Embodiments of the present composite material was prepared in the same manner as that of the First Preferred Embodiment except that the content of the Fe dispersing particles was adjusted to various values, and they were similarly made into the test specimens 1 for the pressing die. By using the pressing dies with the test specimens 1 installed, the test specimens 1 were evaluated for the wear amounts after 100 pressing shots. The results of the evaluation are illustrated in FIG. 3.

Figure 3:
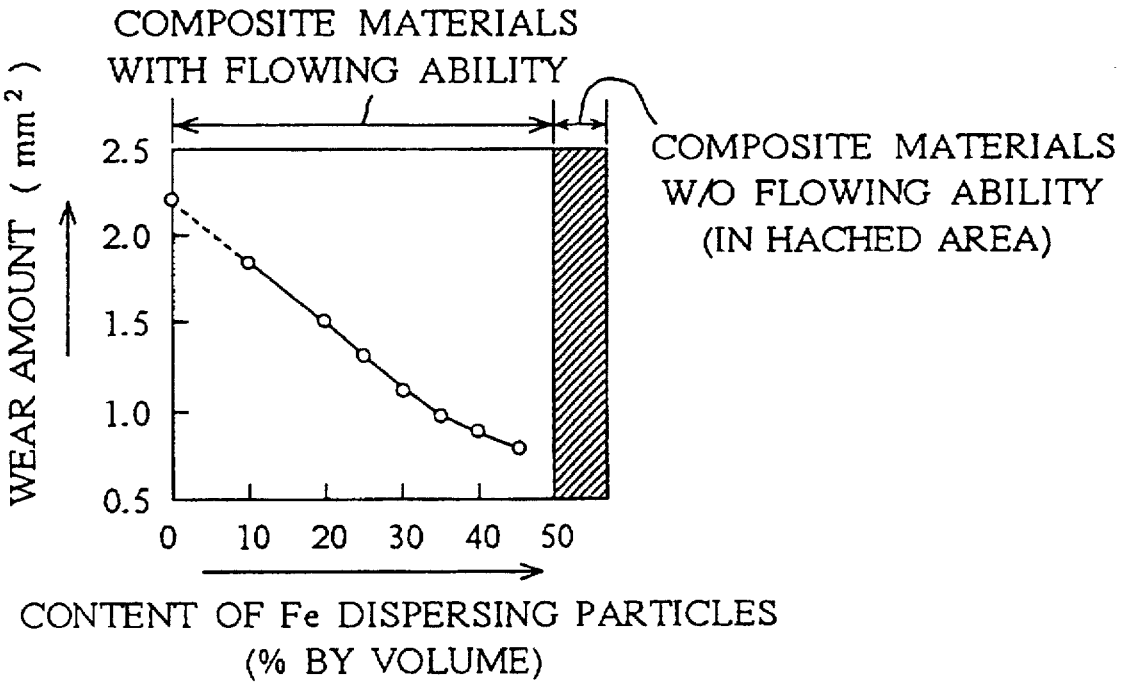
FIG. 3 is a graph for illustrating the relationships between the contents (% by volume), the flowing ability and the wear amounts exhibited by the test specimens made from Second and Fifth Preferred Embodiments of the present composite material during the pressing operation with the galvanized steel sheets, the graph whose axis of abscissa expresses the contents of the metallic dispersing particles dispersed in the matrix of the present composite material and axis of ordinate expresses the wear amounts after carrying out the pressing operation 100 pressing shots.

As illustrated in FIG. 3, when the content of the Fe dispersing particles was less than 10% by volume, the composite material was found to be inferior in the anti-wear property. The more the content of the Fe dispersing particles was increased, the higher the anti-wear property was enhanced. However, when the content of the Fe dispersing particles was more than 50% by volume, the composite material was found to lose the flowing ability. Accordingly, it was found that the present composite material comes to exhibit the superb anti-wear property while preserving a satisfactory flowing ability when the content of the Fe dispersing particles falls in a range of from 10 to 50% by volume. In addition, it is believed that the present composite material including the Fe alloy dispersing particles would bring about similar results.

Thus, the Second Preferred Embodiments of the present composite material including the solid state Fe dispersing particles in the matrix in the content range had the satisfactory flowing ability. When the Second Preferred Embodiments were heated, melted and poured into a mold so as to make the test specimens 1 by casting, they exhibited the molten metal flowing ability and the working ability satisfactorily during the pouring. In addition, there usually arise the adverse effects which result from the distortions caused by the solidification and shrinkage when the liquid state metal is cooled and hardened. However, even after the molten liquid state Second Preferred Embodiments were poured into the mold, cooled and hardened, there arose the adverse effects in a lesser degree because the solid state Fe dispersing particles dispersed in the matrix of the liquid state Second Preferred Embodiments were not solidified and shrunk. Therefore, the resulting test specimens 1 were highly accurate.

Third Preferred Embodiment

The Third Preferred Embodiment of the present composite material comprised a matrix of a low melting point Bi—Sn alloy, and Fe alloy dispersing particles dispersed in the matrix in an amount of 40% by volume.

In particular, the matrix was a Bi—Sn low melting point alloy whose weight contents of Bi and Sn were set at the eutectic point, i.e., Bi:Sn=58:42.

The Fe alloy dispersing particles were prepared by atomizing an Fe alloy powder whose weight contents of Fe and W were set at 76:24, and they had a sphere shape with an average particle diameter of From 100 to 150 micrometers.

The Third Preferred Embodiment of the present composite material was made into the test specimens 1 for the pressing die in the same manner as that of the First Preferred Embodiment, and it was examined for the flowing ability during the casting. The test specimens 1 made from the Third Preferred Embodiment were also subjected to the anti-wear test.

The results of the anti-wear test proved the following. Namely, as illustrated in FIG. 1, the test specimens 1 made from the Third Preferred Embodiment of the present composite material exhibited wear amounts as illustrated by "A2" curve of FIG. 1, and the wear amounts were reduced sharply with respect to those exhibited by the test specimens 1 made from Conventional Example Alloy Nos. 1 and 2 as illustrated by "a1" and "a2" curves of FIG. 1 respectively. The test specimens 1 made from the Third Preferred Embodiment had an anti-wear property much more similar to that of the test specimens 1 made from Conventional Example Alloy No. 3 than the test specimens 1 made from the First Preferred Embodiment did.

Fourth Preferred Embodiment

The Fourth Preferred Embodiment of the present composite material was identical with the First Preferred Embodiment except that a low melting point Sn-8Zn eutectic alloy (mp. 199° C.) was used as the matrix. In particular, the matrix was the low melting point Sn-8Zn eutectic alloy whose weight contents of Sn and Zn were set at the eutectic point, i.e., Sn:Zn=92:8.

The Fourth Preferred Embodiment of the present composite material was made into the test specimens 1 for the pressing die in the same manner as that of the First Preferred Embodiment, and the test specimens 1 were also subjected to the anti-wear test.

Figure 4:
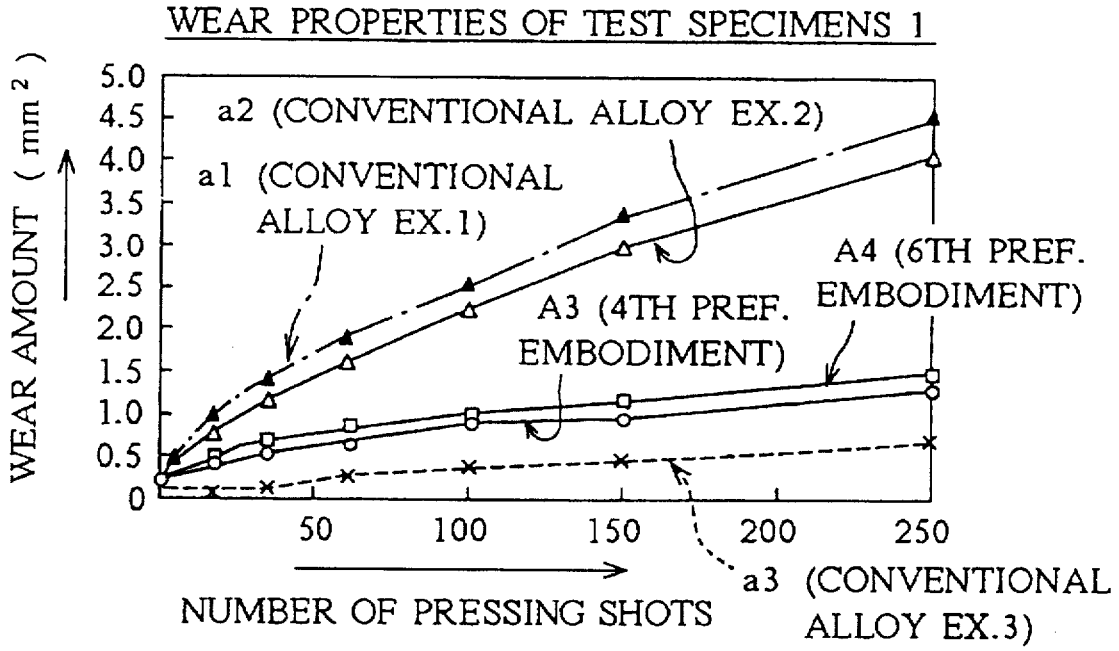
FIG. 4 is a graph for comparing the relationships between the number of pressing shots and the wear amounts exhibited by the test specimens made from Fourth and Sixth Preferred Embodiments of the present composite material and the comparative test specimens made From Conventional Example Alloy Nos. 1 through 3 during the pressing operation with the galvanized steel sheets, the graph whose axis of abscissa expresses the number of pressing shots and axis of ordinate expresses the wear amounts.

The results of the anti-wear test are illustrated in FIG. 4. As illustrated by "A3" curve (designated with the solid lines and blank circles) of FIG. 4, the test specimens 1 made from the Fourth Preferred Embodiment of the present composite material were proved to exhibit wear amounts, which were substantially equal to those exhibited by the First Preferred Embodiment (illustrated by "A1" curve of FIG. 1). Specifically speaking, the wear amounts exhibited by the test specimens made from the Fourth Preferred Embodiment were reduced sharply with respect to those exhibited by the test specimens 1 made from Conventional Example Alloy Nos. 1 and 2 as illustrated by "a1" and "a2" curves of FIG. 4 respectively. Moreover, the test specimens 1 made from the Fourth Preferred Embodiment had an anti-wear property similar to that of the test specimens 1 made from Conventional Example Alloy No. 3 (illustrated by "a3" curve of FIG. 4).

Figure 5:
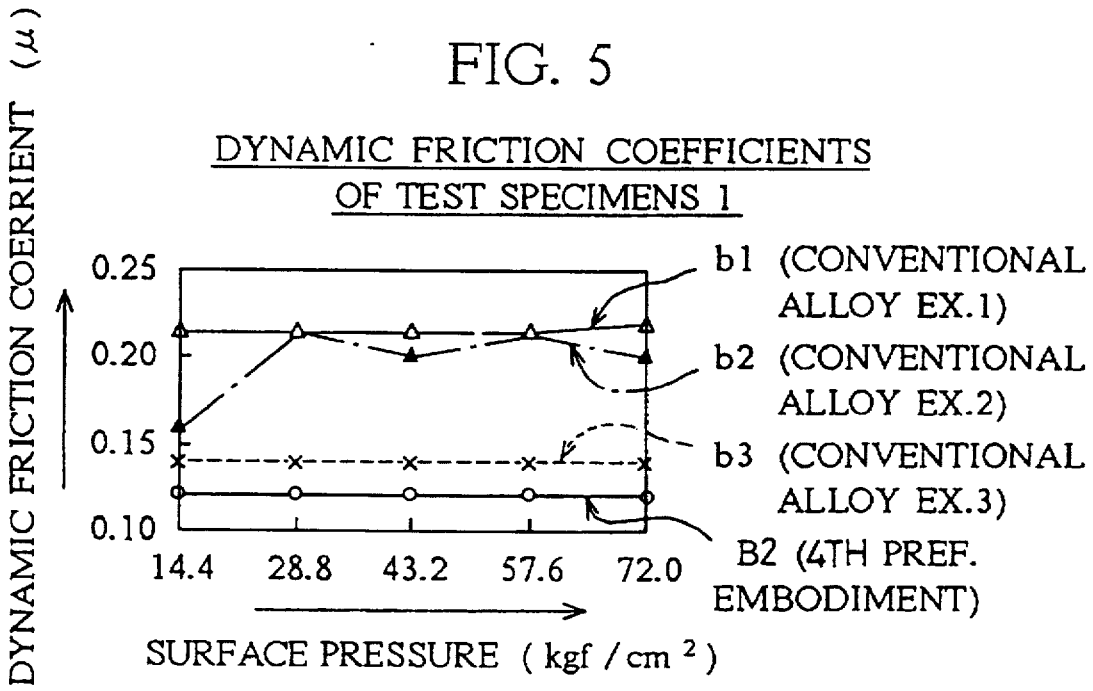
FIG. 5 is a graph for comparing the relationships between the surface pressures (kgf/cm$^2$) and the dynamic friction coefficients (μ) exhibited by the test specimens made from the Fourth Preferred Embodiment and the comparative test specimens made from Conventional Example Alloy Nos. 1 through 3 during the pressing operation with the galvanized steel sheets, the graph whose axis of abscissa expresses the surface pressures and axis of ordinate expresses the dynamic friction coefficients.

As illustrated by "B2" curve (designated with the solid lines and blank circles) of FIG. 5, the test specimens 1 made from the Fourth Preferred Embodiment of the present composite material exhibited a low and constant dynamic friction coefficient (μ) of 0.12 over surface pressures of from 14.4 to 72.0 kgf/cm$^2$. The low and constant dynamic friction coefficient (μ) was reduced by about 43% with respect to those of the test specimens 1 made from Conventional Example Alloy No. 1 illustrated by "b1" curve of FIG. 5.

In addition, since the Fourth Preferred Embodiment of the present composite material employed the low melting point Sn-8Zn eutectic alloy as the matrix, the cost was reduced remarkably to 1/10 of the case where the low melting point Bi—Sn eutectic alloy was used as the matrix.

Fifth Preferred Embodiment

The Fifth Preferred Embodiments of the present composite material were prepared in the same manner as that of the Second Preferred Embodiments except that the low melting point Sn-8Zn eutectic alloy (mp. 199° C.) was used as the matrix, and they were made into the test specimens 1 for the pressing die. By using the pressing dies with the test specimens 1 installed, the test specimens 1 were similarly evaluated for the wear amounts after 100 pressing shots. The results were identical with those of the Second Preferred Embodiments illustrated in FIG. 3.

Sixth Preferred Embodiment

The Sixth Preferred Embodiment of the present composite material was identical with the Third Preferred Embodiment except that a low melting point Sn-0.75Cu eutectic alloy (mp. 227° C.) was used as the matrix. In particular, the matrix was the low melting point Sn-0.75Cu eutectic alloy whose weight contents of Sn and Cu were set at the eutectic point, i.e., Sn:Cu=99.25:0.75.

The Sixth Preferred Embodiment of the present composite material was made into the test specimens 1 for the pressing die in the same manner as that of the First Preferred Embodiment, and the test specimens 1 were also subjected to the anti-wear test.

The results of the anti-wear test are illustrated in FIG. 4. As illustrated by "A4" curve (designated with the solid lines and blank squares) of FIG. 4, the test specimens 1 made from the Sixth Preferred Embodiment of the present composite material were proved to exhibit wear amounts, which were substantially equal to those exhibited by the Fourth Preferred Embodiment (illustrated by "A3" curve of FIG. 4).

Similarly to the Fourth Preferred Embodiment, since the Sixth Preferred Embodiment of the present composite material employed the low melting point Sn-0.75Cu eutectic alloy as the matrix, the cost was reduced remarkably to 1/10 of the case where the low melting point Bi—Sn eutectic alloy was used as the matrix.

Regarding the low melting point Sn alloy, the present invention is not limited to the eutectic low melting point alloys employed in the aforementioned First through Sixth Preferred Embodiments, and the low melting point Sn alloy can be alloys whose weight contents of the components are set around the eutectic point. It was verified that the present composite material having the superior anti-wear property can be made from such alloys.

Seventh Preferred Embodiment

The Seventh Preferred Embodiment of the present composite material was produced as follows. First, Fe—C alloy particles having a substantial sphere shape with a particle diameter of from 10 to 1,000 micrometers were prepared, and the chemical compositions were as set forth below. For example, the Fe—C alloy particles had an average particle diameter of 300 micrometers, and they included Fe in an amount of 99.27% by weight, C in an amount of less than 0.01% by weight, Mn in an amount of 0.10% by weight, P in an amount of 0.26% by weight, S in an amount of less than 0.005% by weight, Al in an amount of 0.11% by weight, Ca in an amount of 0.01% by weight, and Mg in an amount of 0.01% by weight.

Then, the Fe—C alloy particles were electroplated with Sn in an amount of 10% by weight with respect to the weight of the Fe—C alloy particles. The electroplating was carried out with an electric current density of 3 A/dm$^2$. Thereafter, $ZnCl_2 \cdot NH_4Cl$ flux was deposited on the outer peripheral surface of the plating layer in a thickness of 0.5 micrometers, and it was vacuum-dried so as to prepare Fe—C alloy dispersing particles.

Further, a low melting point Sn alloy was heated and melted at 250° C., and the Fe—C alloy dispersing particles were added to the resulting molten low melting point Sn alloy in an amount of 45% by volume. The low melting point Sn alloy was Conventional Example Alloy No. 2 which included Sn in an amount of 40% by weight, Bi in an amount of 55% by weight, and Sb in an amount of 5% by weight. The mixture of Conventional Example Alloy No. 2 and the Fe—C alloy dispersing particles was heated to 400° C. in a vacuum of 0.001 Torr, and it was stirred so as to degas for 2 and half hours. Thereafter, the mixture was cooled to 250° C., and the vacuum was canceled when the mixture was cooled to 250°

C. The mixture was made into ingots immediately, thereby obtaining the Seventh Preferred Embodiment of the present composite material.

The ingots made from the Seventh Preferred Embodiment were examined for their mechanical properties, and compared with those of ingots made from simple Conventional Example Alloy No. 2. The results are set forth in Table 1 below.

Further, the ingots were made into the test specimens 1 for the pressing die in the same manner as that of the First Preferred Embodiment, and the test specimens 1 were also subjected to the anti-wear test. However, in the Seventh Preferred Embodiment, the test specimens 1 were evaluated for the wear amounts after 250 pressing shots, i.e., after pressing 250 pieces of the galvanized steel sheets 4. The results of the anti-wear test are set forth in Table 1 along with the mechanical properties.

Eighth Preferred Embodiment

The Eighth Preferred Embodiment of the present composite material was prepared in the same manner as that of the Seventh Preferred Embodiment except that Ni was plated in an amount of 7% by weight with respect to the weight of the Fe—C alloy particles.

Likewise, the ingots made from the Eighth Preferred Embodiment were also examined for their mechanical properties, and the test specimens 1 made from the ingots were also subjected to the anti-wear property test set forth in the "Seventh Preferred Embodiment" section. The results are also set forth in Table 1 below.

TABLE 1

| | 7th Pref. Embodiment | 8th Pref. Embodiment | Conventional Ex. Alloy No. 2 |
|---|---|---|---|
| Wear Amount ($mm^2$) | 0.81 | 0.83 | 2.20 |
| Vickers Hardness (Hv) | 29.0 | 30.5 | 28.0 |
| Tensile Strength ($kgf/mm^2$) | 6.9 | 6.7 | 7.2 |
| Compression strength ($kgf/mm^2$) | 12.2 | 12.3 | 12.5 |
| Charpy Impact Strength ($kgf\text{-}cm/mm^2$) | 6.0 | 6.0 | 8.5 |

(Note) The wear amount was evaluated at 100 pressing shots.

It is appreciated from Table 1 that the Seventh and Eighth Preferred Embodiments of the present composite material exhibited remarkably improved wear amounts which were far superior to that of Conventional Example Alloy No. 2. Other than the excellent wear amounts, there arouse no appreciable differences between the other mechanical properties of the Seventh and Eighth Preferred Embodiments and those of Conventional Example Alloy No. 2 substantially.

Ninth Preferred Embodiment

The Ninth Preferred Embodiment of the present composite material was produced in the same manner as that of the Seventh Preferred Embodiment except that Fe—W—C alloy particles were used which included W in an amount of 23.92% by weight, C in an amount of 1.14% by weight, Si in an amount of 0.30% by weight, Mn in an amount of 0.30% by weight, P in an amount of 0. 011% by weight, S in an amount of less than 0.019% by weight, Ni in an amount of 0.07% by weight, Cr in an amount of 0.04% by weight, and the balance of Fe, and that the resulting Fe—W—C alloy dispersing particles were added to the low melting point Sn alloy, i.e., Conventional Example Alloy No. 2, in an amount of 40% by volume.

Likewise, as described in the "Seventh Preferred Embodiment" section, the ingots made from the Ninth Preferred Embodiment were examined for their mechanical properties, and the test specimens 1 made from the ingots were subjected to the anti-wear test. The results are set forth in Table 2 below together with those of simple Conventional Example Alloy No. 2 for comparison.

Tenth Preferred Embodiment

The Tenth Preferred Embodiment of the present composite material was prepared in the same manner as that of the Ninth Preferred Embodiment except that Ni was plated in an amount of 7% by weight with respect to the weight of the Fe—W—C alloy particles.

Likewise, as described in the "Seventh Preferred Embodiment" section, the ingots made from the Tenth Preferred Embodiment were examined for their mechanical properties, and the test specimens 1 made from the ingots were subjected to the anti-wear test. The results are set forth in Table 2 below together with those of simple Conventional Example Alloy No. 2 for comparison.

TABLE 2

| | 9th Pref. Embodiment | 10th Pref. Embodiment | Conventional Ex. Alloy No. 2 |
|---|---|---|---|
| Wear Amount ($mm^2$) | 0.51 | 0.50 | 2.20 |
| Vickers Hardness (Hv) | 43.4 | 44.5 | 28.0 |
| Tensile Strength ($kgf/mm^2$) | 4.4 | 4.2 | 7.2 |
| Compression Strength ($kgf/mm^2$) | 13.0 | 12.9 | 12.5 |
| Charpy Impact Strength ($kgf\text{-}cm/mm^2$) | 6.8 | 6.5 | 8.5 |

(Note) The wear amount was evaluated at 100 pressing shots.

It is appreciated from Table 2 that the Ninth and Tenth Preferred Embodiments of the present composite material exhibited not only remarkably improved wear amounts which were far superior to that of Conventional Example Alloy No. 2, but also enhanced Vickers Hardness which were more than 1.5 times that of Conventional Example Alloy No. 2. Other than the excellent wear amounts and the high Vickers hardness, there arouse no appreciable differences between the other mechanical properties of the Ninth and Tenth Preferred Embodiments and those of Conventional Example Alloy No. 2 substantially.

Eleventh Preferred Embodiment

The Eleventh Preferred Embodiment of the present composite material was produced as follows. First, Fe—C alloy particles having a substantial sphere shape with a particle diameter of from 10 to 1,000 micrometers were prepared, and the chemical compositions were as set forth below. For example, the Fe—C alloy particles had an average particle diameter of 300 micrometers, and they included Fe in an amount of 99.27% by weight, C in an amount of less than 0.01% by weight, Mn in an amount of 0.10% by weight, P in an amount of 0.26% by weight, S in an amount of less than 0.005% by weight, Al in an amount of 0.11% by weight, Ca in an amount of 0.01% by weight, and Mg in an amount of 0.01% by weight.

Then, the Fe—C alloy particles were electroplated with Sn in an amount of 10% by weight with respect to the weight of the Fe—C alloy particles. The electroplating was carried out with an electric current density of 3 A/dm$^2$, thereby forming an Sn plating layer on the outer peripheral surface of the Fe—C alloy particles in an average thickness of about 6 micrometers.

Thereafter, $ZnCl_2 \cdot NH_4Cl$ flux including $ZnCl_2$ in an amount of 16.4% by weight, $NH_4Cl$ in an amount of 3.0% by weight and $H_2O$ in an amount of 80.6% by weight was diluted with water to a rate of 1/10, thereby preparing a diluted flux solution. The Fe—C alloy particles with the Sn plating layer formed were immersed into the diluted flux solution, and then they were vacuum-dried, thereby depositing the oxidation inhibitor flux layer on the outer peripheral surface of the Sn plating layer in an average thickness of about 0.4 micrometers. The coated particles are thus produced.

Further, a low melting point Bi—Sn alloy powder was produced. The Bi—Sn alloy powder included Sn in an amount of 40% by weight, Bi in an amount of 55% by weight and Sb in an amount of 5% by weight, and it had a particle diameter of from 100 to 500 micrometers. The Bi—Sn alloy powder and the coated particles were mixed so that the volume ratio of the coated particles was 40% by volume, thereby preparing a mixed powder. The mixed powder was charged in a container made of stainless steel and adapted for heating and stirring in vacuum, and it was heated to 250° C., thereby carrying out dispersion and mixing. Immediately thereafter, the container was evacuated to a vacuum degree of 0.001 Torr, and it was heated to 400° C. so as to stir and degas the molten mixture for 2 hours. Finally, the vacuum was canceled when the molten mixture was cooled to 250° C., and the molten mixture was cast into ingots under atmospheric pressure.

Evaluation on the Mechanical Properties of the Eleventh Preferred Embodiment

The ingots mare from the Eleventh Preferred Embodiment were examined for their mechanical properties, e.g., the wear amount, the Vickers hardness, the tensile strength, the compression strength and the Charpy impact strength. The results are set forth in Table 3 below. For comparison, Conventional Example Alloy No. 2 was prepared with the same low melting point Bi—Sn alloy as that of the Eleventh Preferred Embodiment and cast into ingots in the same manner as the Eleventh Preferred Embodiment except that no coated particles were added. Likewise, the ingots made from the Conventional Example Alloy No. 2 were examined for their mechanical properties. The results are also summarized in Table 3 below.

Further, the ingots were made into the test specimens 1 or the pressing die in the same manner as that of the First Preferred Embodiment, and the test specimens 1 were also subjected to the anti-wear test. However, in the Eleventh Preferred Embodiment, the test specimens 1 were evaluated for the wear amounts after 250 pressing shots, i.e., after pressing 250 pieces of the galvanized steel sheets 4. The results of the anti-wear test are set forth in Table 3 along with the mechanical properties.

TABLE 3

| | 11th Pref. Embodiment | Conventional Ex. Alloy No. 2 |
|---|---|---|
| Wear Amount (mm$^2$) | 0.80 | 2.20 |
| Vickers Hardness (Hv) | 29.1 | 28.0 |
| Tensile Strength (kgf/mm$^2$) | 6.8 | 7.2 |
| Compression Strength (kgf/mm$^2$) | 13.2 | 12.5 |
| Charpy Impact Strength (kgf-cm/mm$^2$) | 6.1 | 8.5 |

(Note) The wear amount was evaluated at 100 pressing shots.

It is appreciated from Table 3 that the casting according to the Eleventh Preferred Embodiment exhibited remarkably improved wear amount over that of Conventional Example Alloy No. 2. Further, regarding the other mechanical properties, it was verified to have the mechanical properties equivalent to or better than those of Conventional Example Alloy No. 2.

In addition, the casting according to the Eleventh Preferred Embodiment was cut to observe the inside. It was found that the Fe—C alloy particles (i.e., the reinforcing material) were dispersed uniformly in the matrix of the low melting point Bi—Sn alloy, and that blowholes were little present therein.

In particular, the casting process has been employed to produce the present composite material. However, the present invention is not limited thereto, for instance, the present composite material can be also produced by charging the mixed powder containing the low melting point Sn alloy powder the coated particles according to the present invention in a mold, and thereafter by heating the mold to a predetermined temperature.

Twelfth Preferred Embodiment

The coated particles of the present composite material according the Twelfth Preferred Embodiment were produced in the same manner as those of the Eleventh Preferred Embodiment except that no oxidation inhibitor layer was formed on the outer peripheral surface of the Sn plating layer of the coated particles.

Further, a low melting point Bi—Sn alloy ingot was prepared. The ingot included Sn in an amount of 40% by weight, Bi in an amount of 55% by weight and Sb in an amount of 5% by weight. The ingot and the coated particles were charged in a container, which was made of stainless steel and adapted for heating and stirring in vacuum, so that the volume ratio of the coated particles was 40% by volume. Then, the container was evacuated to a vacuum degree of 0.001 Torr, and thereafter it was heated to 250° C. so as to melt the Bi—Sn alloy. The mixture of the melted Bi—Sn alloy and the coated particles was stirred and mixed for 2 hours, thereby carrying out dispersion and mixing. Finally, the atmospheric pressure was resumed in the container, and ingots were made by casting.

Evaluation on the Mechanical Properties of the Twelfth Preferred Embodiment

Likewise, the ingots made from the Twelfth Preferred Embodiment were examined for their mechanical properties, e.g., the wear amount, the Vickers hardness, the tensile strength, the compression strength and the Charpy impact strength, and the results of the examination were compared with those of Conventional Example Alloy No. 2. The ingots made from Conventional Example Alloy No. 2 were prepared with the same low melting point Bi—Sn alloy as that of the Twelfth Preferred Embodiment and cast in the same manner as the Twelfth Preferred Embodiment except that no coated particles were added. The results are summarized in Table 4 below.

TABLE 4

| | 12th Pref. Embodiment | Conventional Ex. Alloy No. 2 |
|---|---|---|
| Wear Amount ($mm^2$) | 0.79 | 2.20 |
| Vickers Hardness (Hv) | 29.3 | 28.0 |
| Tensile Strength ($kgf/mm^2$) | 6.8 | 7.2 |
| Compression Strength ($kgf/mm^2$) | 13.0 | 12.5 |
| Charpy Impact Strength ($kgf\text{-}cm/mm^2$) | 5.9 | 8.5 |

(Note) The wear amount was evaluated at 100 pressing shots.

As can be appreciated from Table 4, the casting according to the Twelfth Preferred Embodiment was remarkably improved in the wear amount over that of Conventional Example Alloy No. 2. Further, the other mechanical properties were verified to be equivalent to or better than those of Conventional Example Alloy No. 2.

In addition, the casting according to the Twelfth Preferred Embodiment was cut, and the inside was observed. The Fe—C alloy particles (i.e., the reinforcing material) were found to be dispersed uniformly in the matrix of the low melting point Bi—Sn alloy, and the blowholes were little present in the casting.

Thirteenth Preferred Embodiment

The Thirteenth Preferred Embodiment of the present composite material was produced as follows. First, 1 kg of spherical Fe particles were washed with a 10%-by-volume aqueous hydrochloric solution. The Fe particles had a particle diameter of from 70 to 200 micrometers, and their average particle diameter was 130 micrometers. Then, the Fe particles were electroplated with an Sn plating solution (e.g., "TV-1004 MSS" produced by DIPSOLE Co., Ltd.). The electroplating was carried out with an electric current density of 3 $A/dm^2$ so as to adjust a ratio of the Sn plating layer to 15% by weight with respect to the Fe particles, thereby forming an Sn plating layer on the outer peripheral surface of the Fe particles in an average thickness of about 4 micrometers. The coated particles are thus prepared. Further, the coated particles are fully washed with water, and they were vacuum-dried for 24 hours.

Further, a low melting point Bi—Sn alloy ingot was prepared. The ingot included Sn in an amount of 72% by weight and Bi in an amount of 28% by weight. The ingot were heated to 165° C., thereby producing the partially molten state. In the partially molten low melting point Bi—Sn alloy, the ratio of the liquid phase:the solid phase was 1:1. Then, under atmospheric pressure, the coated particles were charged into the partially molten low melting point Bi—Sn alloy so that the volume ratio of the coated particles was 40% by volume. The mixture was fully stirred, thereby dispersing the coated particles in the partially molten low melting point Bi—Sn alloy.

Furthermore, the composition of the partially molten low melting Bi—Sn alloy was adjusted to the eutectic composition (e.g., 43% by weight Sn-57% by weight Bi) by adding Bi.

Finally, under atmospheric pressure, the resulting mixture was cast into ingots.

Fourteenth Preferred Embodiment

The Fourteenth Preferred Embodiment of the present composite material was produced in the same manner as that of the Thirteenth Preferred Embodiment except the following arrangements. Spherical Fe particles having a particle diameter of from 100 to 400 micrometers were employed in order to prepare the coated particles, and their average particle diameter was 250 micrometers.

Moreover, the composition of the partially molten low melting Bi—Sn alloy was adjusted to a composition, e.g., 45% by weight Sn-50% by weight Bi-5% by weight Sb by adding Bi and Sb.

Finally, under atmospheric pressure, the resulting mixture was similarly cast into ingots.

Fifteenth Preferred Embodiment

The Fifteenth Preferred Embodiment of the present composite material was produced in the same manner as that of the Thirteenth Preferred Embodiment except the following arrangements. Spherical Fe particles having a particle diameter of from 100 to 400 micrometers were employed in order to prepare the coated particles, and their average particle diameter was 250 micrometers. Instead of the Sn plating layer, an Ni plating layer was formed on the outer peripheral surface of the Fe particles in a ratio 2% by weight with respect to the Fe particles.

Moreover, the composition of the partially molten low melting Bi—Sn alloy was adjusted to a composition, e.g., 45% by weight Sn-50% by weight Bi-5% by weight Sb by adding Bi and Sb.

Finally, under atmospheric pressure, the resulting mixture was similarly cast into ingots.

Comparative Example No. 1

Comparative Example No. 1 was produced in the same manner as that of the Thirteenth Preferred Embodiment except the following arrangements. The Fe particles were used as they were, namely they were not subjected to the electroplating. Under atmospheric pressure, the Fe particles were charged into the partially molten low melting point Bi—Sn alloy as that of the Thirteenth Preferred Embodiment so that the volume ratio of the Fe particles was 40% by volume. However, the Fe particles exhibited such a dispersibility that they could not be mixed with and dispersed satisfactorily in the partially molten low melting point Bi—Sn alloy.

Comparative Example No. 2

Comparative Example No. 2 was produced in the same manner as that of the Thirteenth Preferred Embodiment except the following arrangements. A low melting point Bi—Sn alloy ingot was prepared. The ingot had the eutectic composition, and it included Sn in an amount of 43% by weight and Bi in an amount of 57% by weight. The ingot was heated to 160° C., thereby producing the completely molten state. Then, under atmospheric pressure, the coated particles were charged into the completely molten low melting point Bi—Sn alloy so that the volume ratio of the coated particles was 40% by volume. However, the coated particles could not be dispersed fully in the completely molten low melting point Bi—Sn alloy.

Evaluation on Dispersibility

The coated particles or the Fe particles were examined for the dispersibility when they were mixed with and dispersed in the partially molten or the completely molten low melting point Bi—Sn alloy during the production process for the Thirteenth through Fifteenth Preferred Embodiments and Comparative Example Nos. 1 and 2. The results of the evaluation are summarized in Table 5 below.

TABLE 5

| | Matrix Composition at Charging (wt. %) | Matrix Composition at Casting (wt. %) | Plating Layer | Temperature at Charging (°C.) | Ratio of Liquid Phase/Solid Phase | Dispersibility |
|---|---|---|---|---|---|---|
| 13th Pref. Embodiment | Sn-28Bi | Sn-57Bi | Sn, 15% | 165 | 1:1 | good |
| 14th Pref. Embodiment | Sn-28Bi | Sn-50Bi-5Sb | Sn, 15% | 165 | 1:1 | good |
| 15th Pref. Embodiment | Sn-28Bi | Sn-50Bi-5Sb | Ni, 2% | 165 | 1:1 | good |
| Comp. Ex. No. 1 | Sn-28Bi | Sn-57Bi | none | 165 | 1:1 | poor |
| Comp. Ex. No. 2 | Sn-57Bi | Sn-57Bi | Sn, 15% | 160 | 100:1 | poor |

As can be understood from Table 5, during the production process or the Thirteenth through Fifteenth Preferred Embodiments, a the coated particles exhibited the extremely good dispersibility when they were stirred and mixed with the partially molten low melting point Bi—Sn alloy. On the other hand, during the production process for Comparative Example No. 1 in which the Fe particles free from the plating layer should have been stirred and mixed with the partially molten Bi—Sn low melting point alloy, the Fe particles exhibited such a wettability to the matrix that they could not be dispersed satisfactorily in it. Moreover, during the production process for Comparative Example No. 2 in which the coated particles should have been stirred and mixed with the completely molten matrix which contained 43% by weight Sn and 57% by weight Bi at the charging and which included the sole liquid phase, they were ascended to the surface of the liquid phase matrix and could not be dispersed fully in the matrix because they were not caught and held by the solid chase matrix.

Evaluation on the Mechanical Properties of the Thirteenth and Fifteenth Preferred Embodiments Likewise, the ingots made from the Thirteenth and Fifteenth Preferred Embodiments were examined for their mechanical properties, e.g., the wear amount, the Vickers hardness, the tensile strength, the compression strength and the Charpy impact strength, and the results are summarized in Table 6 below. For comparison, Comparative Example No. 3 were similarly examined therefor, and the results are summarized in Table 6 as well. The ingots of Comparative Example No. 3 were made only from a low melting point Sn alloy which included 45% by weight Sn, 50% by weight Bi and 5% by weight Sb.

TABLE 6

| | 13th Pref. Embodiment | 15th Pref. Embodiment | Comparative Ex. No. 3 |
|---|---|---|---|
| Wear Amount ($mm^2$) | 0.90 | 0.87 | 2.30 |
| Vickers Hardness (Hv) | 30.0 | 32.0 | 28.0 |
| Tensile Strength ($kgf/mm^2$) | 5.6 | 5.5 | 7.0 |
| Compression Strength ($kgf/mm^2$) | 12.0 | 13.0 | 12.0 |
| Charpy Impact Strength ($kgf\text{-}cm/mm^2$) | 6.0 | 7.4 | 8.5 |

(Note) The wear amount was evaluated at 100 pressing shots.

It is appreciated from Table 6 that the Thirteenth and Fifteenth Preferred Embodiments of the present composite material exhibited remarkably improved wear amounts which were far superior to that of Comparative Example No. 3. In addition to the excellent wear amounts, they were verified to have the mechanical properties which were substantially equivalent to those of Comparative Example No. 3.

Moreover, the castings according to the Thirteenth through Fifteenth Preferred Embodiment were cut, and their inside was observed. The Fe particles (i.e., the reinforcing material) were found to be dispersed uniformly in the matrix of the low melting point Bi—Sn alloys, and the blowholes were little present in the castings.

Sixteenth Preferred Embodiment

The Sixteenth Preferred Embodiment of the present composite material comprised a matrix of a low melting point Sn alloy, Fe dispersing particles dispersed in the matrix in an amount of 40% by volume, and $FeSn_2$ intermetallic compound particles dispersed in the matrix in an amount of 10% by volume.

In particular, the low melting point Sn alloy constituting the matrix included Bi in an amount of 60% by weight, Sn in an amount of 35% by weight and Sb in an amount of 5% by weight.

The Fe dispersing particles were prepared by atomizing an Fe powder, and they had a sphere shape with an average particle diameter of from 200 to 300 micrometers.

The $FeSn_2$ intermetallic compound particles comprised Fe and Sn which were combined in an integer ratio of Fe:Sn=1:2. The elements resulted from the Fe dispersing particles dispersed in the matrix and the low melting point Sn alloy constituting the matrix. They had an average particle diameter of 30 micrometers or less.

The $FeSn_2$ intermetallic compound particles were obtained from the intermetallic compound which was produced between the Fe dispersing particles and the matrix, namely which were produced at the boundaries between the Fe dispersing particles and the matrix when the Fe dispersing particles are dispersed in the matrix. Specifically speaking, after the intermetallic compound was produced at the boundaries between the Fe dispersing particles and the matrix, the Fe dispersing particles and the matrix were held at a predetermined high temperature and stirred forcibly with an impeller, thereby separating the intermetallic compound from the boundaries in a form of particles and simultaneously dispersing them in the matrix together with the Fe dispersing particles.

Figure 10:
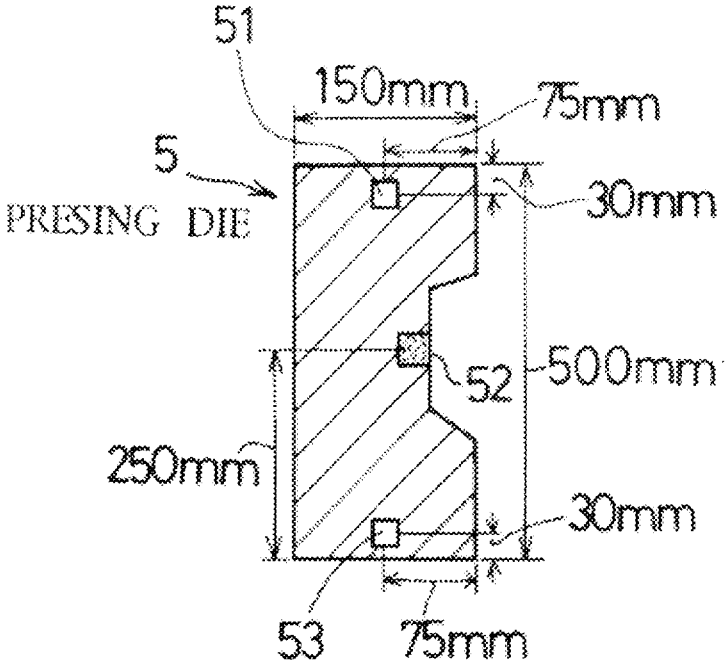
FIG. 10 is a cross-sectional view of the pressing die made from the Sixteenth Preferred Embodiment thereof.

When the composite material of the Sixteenth Preferred Embodiment was used to prepare a cast-structure by casting, e.g., a pressing die 5 illustrated in FIG. 10, it exhibited a good flowing ability.

Figure 9:
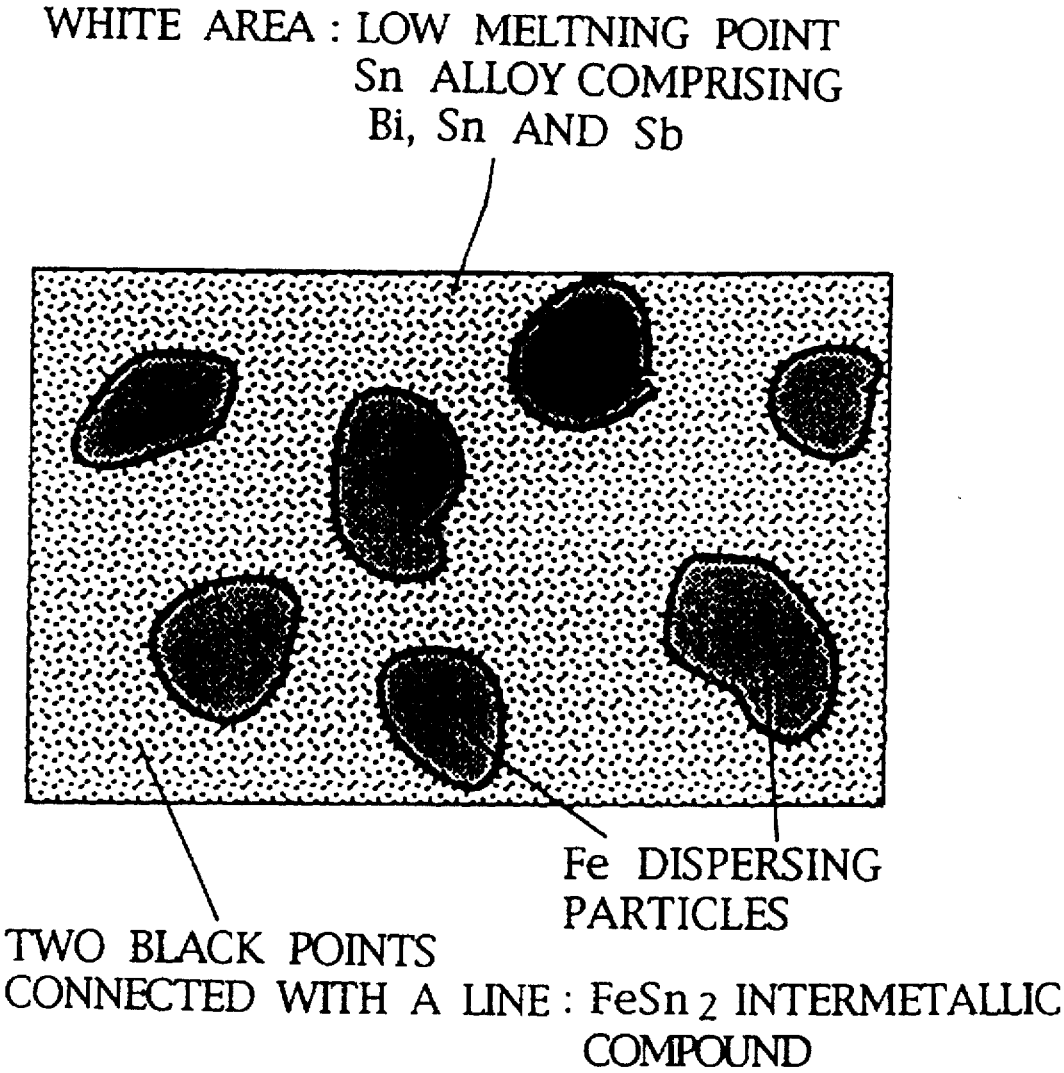
FIG. 9 is an enlarged schematic illustration of a metallic structure of a pressing die made from Sixteenth Preferred Embodiment of the modified present composite material.

Further, as illustrated in FIG. 9, it was verified that the pressing die 5 prepared with the composite material of the Sixteenth Preferred Embodiment had a metallic structure in which the $FeSn_2$ intermetallic compound particles (two black points connected with a line) and the Fe dispersing particles were dispersed uniformly in the low melting point Sn alloy comprised of Bi, Sn and Sb (white area).

Figure 11:
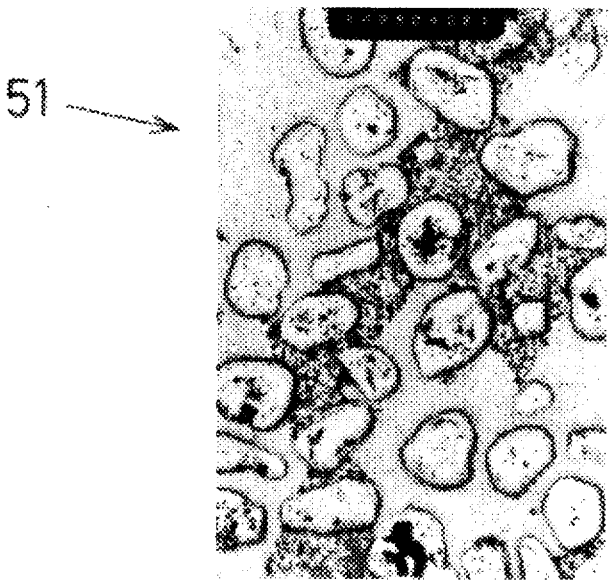
FIG. 11 is a photograph (magnification ×50) taken with a scanning electron microscope and shows a metallic structure at an upper portion of the pressing die made from the Sixteenth Preferred Embodiment.
Figure 12:
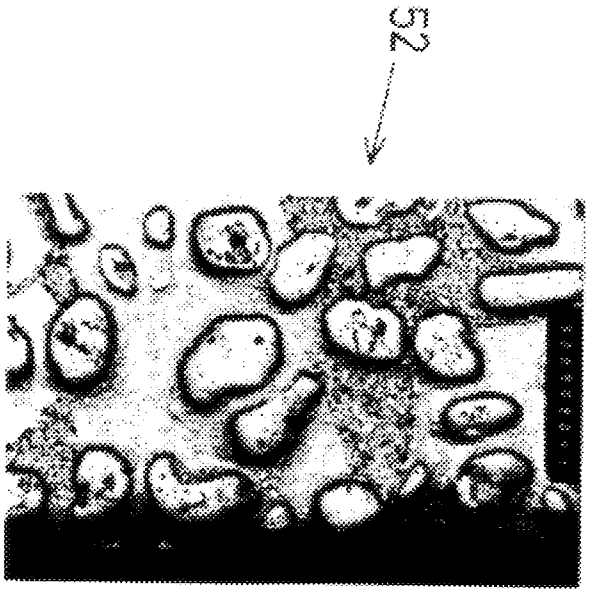
FIG. 12 is a photograph (magnification ×50) taken with a scanning electron microscope and shows a metallic structure at a center portion of the pressing die made from the Sixteenth Preferred Embodiment.
Figure 13:
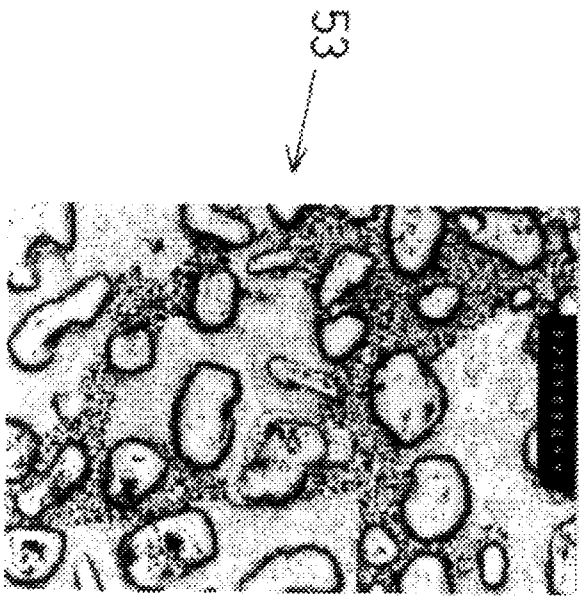
FIG. 13 is a photograph (magnification ×50) taken with a scanning electron microscope and shows a metallic structure at a lower portion or the pressing die made from the Sixteenth Preferred Embodiment.

Furthermore, the $FeSn_2$ intermetallic compound particles and the Fe dispersing particles were examined for their dispersibility in the pressing die 5 (illustrated in FIG. 10) which was made from the composite material of the Sixteenth Preferred Embodiment by casting. Namely, test specimens were collected from the pressing die 5 which were cut in halves, and their metallic structures were observed with a scanning electron microscope. For example, as illustrated in FIG. 10, a first test specimen 51 was collected from the upper portion in cross-section, a second test specimen 52 was collected vertically from the center of the die surface, and a third test specimen 53 was collected from the lower portion in cross-section. FIGS. 11, 12 and 13 are the photographs (magnification ×50) of the metallic structures of the first, second and third test specimens 51, 52 and 53, which were taken with the scanning electron microscope, respectively. As can be seen from FIGS. 11 through 13, the $FeSn_2$ intermetallic compound particles and the Fe dispersing particles were dispersed well in the pressing die 5. Thus, the reinforcing materials, the Fe dispersing particles and the $FeSn_2$ intermetallic compound particles, were found to be dispersed uniformly in the matrix of the low melting point Sn alloy, and the blowholes were little present in the pressing die 5.

The Fe dispersing particles and the $FeSn_2$ intermetallic compound particles were dispersed uniformly, because the $FeSn_2$ intermetallic compound particles had a specific gravity of 8.5 which fell between 8.7 (e.g., the specific gravity of the low melting point Sn alloy) and 7.8 (e.g., the specific gravity of the Fe dispersing particles) and which was close to 8.7, the specific gravity of the low melting point Sn alloy, and because they exhibited a good wettability to the low melting point Sn alloy. Thus, it is believed that the $FeSn_2$ intermetallic compound particles are dispersed uniformly, that the uniformly dispersed $FeSn_2$ intermetallic compound particles hold the Fe dispersing particles between themselves, and that the Fe dspersing particles are accordingly dispersed uniformly.

Evaluation on the Mechanical Properties of the Sixteenth Preferred Embodiment

Likewise, the ingots made from the Sixteenth Preferred Embodiment were examined for their mechanical properties, e.g., the wear amount, the Vickers hardness, the tensile strength, the compression strength and the Charpy impact strength, and the results are summarized and compared with those of the First Preferred Embodiment and Conventional Example Alloy No. 2 in Table 7 below.

TABLE 7

| | 16th Pref. Embodiment | 17th Pref. Embodiment | 1st Pref. Embodiment | Conventional Ex. Alloy No. 2 |
|---|---|---|---|---|
| Wear Amount ($mm^2$) | 0.81 | 1.10 | 0.90 | 2.23 |
| Vickers Hardness (Hv) | 54.3 | 64.7 | 64.7 | 28.0 |
| Tensile. Strength ($kgf/mm^2$) | 5.2 | 7.0 | 6.9 | 7.2 |
| Compression Strength ($kgf/mm^2$) | 14.9 | 13.5 | 12.3 | 12.5 |
| Charpy Impact Strength ($kgf\text{-}cm/mm^2$) | 7.0 | 8.0 | 6.0 | 8.5 |

(Note) The wear amount was evaluated at 100 pressing shots.

As set forth in Table 7, it was verified that the castings made from the Sixteenth Preferred Embodiment of the present composite material exhibited the wear amount (or anti-wear property) and the other mechanical properties which were close to those exhibited by the castings made from the First Preferred Embodiment.

Moreover, the test specimen 1 was cut in order to verify the factors which improved the anti-wear property of the test specimen 1 made from the composite material of the Sixteenth Preferred Embodiment. The internal metallic structure in the cut and exposed cross-section was examined, under a load of 5 grams, for the hardness (in Hv) of the Fe dispersing particles, the $FeSn_2$ intermetallic compound particles, and the Bi regions as well as the Sn regions constituting the matrix with a micro-Vickers hardness tester. The results of the hardness measurement are set forth in Table 8 below.

TABLE 8

| | Hardness of Components in Composite Material of 16th Pref. Embodiment | | | |
|---|---|---|---|---|
| | Fe Dispersing Particles | $FeSn_2$ Intermetallic Compound Particles | Bi Region | Sn Region |
| Average Hardness (in Hv) | 210 | 461 | 36.3 | 50.5 |
| Deviation (in Hv) | 16 | 58 | 3.3 | 6.4 |
| No. of Test Specimens | 18 | 11 | 20 | 7 |

According to Table 8, the $FeSn_2$ intermetallic compound particles constituting the composite material had a hardness of 461 in Hv which was remarkably harder than 210 in Hv, the hardness of the Fe dispersing particles. Hence, the hardness of the $FeSn_2$ intermetallic compound is believed to largely contribute to the hardness of the composite material.

Seventeenth Preferred Embodiment

The Seventeenth Preferred Embodiment of the present composite material comprised a matrix, and $FeSn_2$ intermetallic compound particles dispersed in the matrix in an amount of 40% by volume and having an average particle diameter of from 20 to 30 micrometers.

In particular, the matrix comprised a low melting point Bi—Sn alloy included Bi and Sn, and its composition was adjusted to the eutectic point, Bi:Sn=58:42 in by weight.

Similarly to the Sixteenth Preferred Embodiment, when the composite material of the Seventeenth Preferred Embodiment was used to prepare the pressing die 5 illustrated in FIG. 10 by casting, it also exhibited a good flowing ability.

Evaluation on the Mechanical Properties of the Seventeenth Preferred Embodiment

Likewise, the ingots made from the Seventeenth Preferred Embodiment were examined for their mechanical properties, e.g., the wear amount, the Vickers hardness, the tensile strength, the compression strength and the Charpy impact strength, and the results are summarized in Table 7 above.

As shown in Table 7, the castings made from the Sixteenth Preferred Embodiment or the present composite material were likewise verified to exhibit the anti-wear property and the other mechanical properties which were nearly identical with those exhibited by the castings made from the First Preferred Embodiment.

Having now fully described the present invention, it will be apparent to one of ordinary skill in the art that many changes and modifications can be made thereto without departing from the spirit or scope of the present invention as set forth herein including the appended claims.

What is claimed is:

1. A process for producing metallic alloy particles adapted for dispersion in a matrix of a composite material having an anti-wear property, comprising the steps of:

electroplating a plating layer including either Sn or Ni on outer peripheral surfaces of at least one group of particles selected from the group consisting of Fe—C alloy particles and Fe—W—C alloy particles with an electric current density of from 0.5 to 5.0 A/dm$^2$ so as to electroplate Sn in an amount of from 1 to 15% by weight or Ni in an amount of from 1 to 10% by weight with respect to said particles;

immersing said particles having said plating layer formed thereon into a $ZnCl_2 \cdot NH_4Cl$ flux so as to deposit a layer of the flux on outer peripheral surfaces of said particles having said plating layer formed thereon, the flux layer having a thickness of from 0.18 to 0.78 micrometers; and vacuum-drying said particles having said flux deposited thereon.

2. A process according to claim 1, wherein said particles are an Fe—C alloy consisting essentially of C in an amount of 2% by weight or less and the balance of Fe and inevitable impurities.

3. The process according to claim 1, wherein said particles are an Fe—W—C alloy consisting essentially of C in an amount of 2% by weight or less, W in an amount of from 20 to 30% by weight and the balance of Fe and inevitable impurities.

4. The process according to claim 1, wherein said particles have a substantially spherical shape with a particle diameter of from 10 to 1,000 micrometers.

5. The process according to claim 4, wherein said particles have a particle diameter of from 200 to 300 micrometers.

6. The process according to claim 1, wherein said electroplating step is carried out with an electric current density of from 0.5 to 4.0 A/dm $^2$.

7. The process according to claim 1, wherein said electroplating is carried out so as to electroplate on said particles either Sn in an amount of from 2.0 to 10.0% by weight or Ni in an amount of from 2.0 to 8% by weight with respect to said particles.

8. The process according to claim 1, wherein said immersing step is carried out so as to deposit said flux layer on said outer peripheral surfaces of said particles having said plating layer formed thereon, the flux layer having a thickness of from 0.30 to 0.60 micrometers.

* * * * *